US006576414B1

(12) United States Patent
Irving et al.

(10) Patent No.: US 6,576,414 B1
(45) Date of Patent: Jun. 10, 2003

(54) CORE/SHELL SILVER DONORS FOR PHOTOTHERMOGRAPHIC SYSTEMS COMPRISING AN OXIDATIVELY MORE REACTIVE SHELL

(75) Inventors: Mark E. Irving, Rochester, NY (US); David H. Levy, Rochester, NY (US); Bernard D. Stich, Rochester, NY (US); Mark R. Mis, Rochester, NY (US); Stephen Swingley, Rochester, NY (US); Donald L. Black, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/990,720

(22) Filed: Nov. 21, 2001

(51) Int. Cl.[7] ..... G03C 1/498; G03C 1/494; G03C 1/015

(52) U.S. Cl. ..... 430/619; 430/505; 430/543; 430/559; 430/566; 430/620; 430/959; 430/964

(58) Field of Search ..... 430/619, 505, 430/618, 620, 964, 566, 543, 559, 959; 556/114; 503/210

(56) References Cited

U.S. PATENT DOCUMENTS 4,665,012 A 5/1987 Sugimoto et al.
6,355,408 B1 3/2002 Whitcomb et al.

*Primary Examiner*—Thorl Chea
(74) *Attorney, Agent, or Firm*—Chris P. Konkol

(57) ABSTRACT

The present invention is directed to a photothermographic element comprising silver halide, a blocked developer, a coupler, and core/shell particles, each such particle comprising a mixture of at least two non-photosensitive organic silver salts, which particle comprises a center portion comprising a non-photosensitive first organic silver salt and at least one shell portion covering the center portion, the shell comprising a non-photosensitive second organic silver salt. The organic silver salt in the shell has a lower pKsp relative to the organic silver salt in the core. This invention also provides a composition comprising the core/shell non-photosensitive organic silver salt particles, and a method of making the particles.

47 Claims, No Drawings

CORE/SHELL SILVER DONORS FOR PHOTOTHERMOGRAPHIC SYSTEMS COMPRISING AN OXIDATIVELY MORE REACTIVE SHELL

FIELD OF THE INVENTION

This invention relates to color photothermographic capture films that are intended to be developed by the application of heat, preferably in the absence of conventional processing solutions. In particular, this invention relates to novel non-photosensitive core/shell particles comprising organic silver salts and their use in imaging compositions, and methods for preparing such particles.

BACKGROUND OF THE INVENTION

Photographic imaging elements that can be processed, after imagewise exposure, simply by heating the element are referred to as photothermographic elements. Subsequent processing steps may employ liquid processing. Preferably, photothermographic films do not require any processing solutions and instead contain within them all the chemistry required for the formation of a photographic image in the film. These film chemistries are designed so that at room temperature they are inactive, but at elevated temperatures (greater than 120° C.) the film chemistries become functionally active.

In such materials, a photosensitive catalyst is generally a photographic-type photosensitive silver halide that is considered to be in catalytic proximity to a non-photosensitive source of reducible silver ions. Catalytic proximity requires intimate physical association of these two components either prior to or during the thermal image development process so that when silver atoms, $(Ag^0)_n$, also known as silver specks, clusters, nuclei, or latent image, are generated by irradiation or light exposure of the photosensitive silver halide, those silver atoms are able to catalyze the reduction of the reducible silver ions within a catalytic sphere of influence around the silver atoms (Klosterboer, Neblette's Eighth Edition: *Imaging Processes and Materials*, Sturge, Walworth & Shepp (eds.), Van Nostrand-Reinhold, New York, Chapter 9, pages 279–291, 1989). It has long been understood that silver atoms act as a catalyst for the reduction of silver ions, and that the photosensitive silver halide can be placed in catalytic proximity with the non-photosensitive source of reducible silver ions in a number of different ways (see, for example, *Research Disclosure*, June 1978, item 17029). The non-photosensitive source of reducible silver ions is typically a material that contains reducible silver ions. Typically, the preferred non-photosensitive source of reducible silver ions is a silver salt of an organic compound.

Non-photosensitive core/shell silver salts as sources of reducible silver ions for monochromic systems is described in commonly assigned and co-pending U.S. Ser. No. 09/761,954 (filed Jan. 17, 2001 by Whitcomb and Pham), incorporated here by reference. These silver salts include a core comprised of one or more silver salts and a shell having one or more different silver salts.

Core/shell silver halide emulsions are known, as disclosed by H. Hirsch, *J. Photog. Sci.*, vol. 10, pp. 129–134, 1962; H. Hirsch, *J. Photog. Sci.*, vol. 10, pp. 134–146, 1962; E. Klein and E. Moisar, German Patent DT 1,169,290, 1964; L. Ketellapper, H. Horignon, and L. Libeer, *J. Photog. Sci.*, vol. 26, p. 189, 1978; T. Sugimoto and S. Yamada, U.S. Pat. No. 4,665,012, 1987; S. Matsuzaka et. al, European Patent EP 202,784, 1986; and S. Bando, Y. Shibahara, and S. Ishimaru, *J. Imaging Sci.*, vol. 29, p. 193, 1985. However, silver-halide core/shell particles are for the purpose of photoefficiency and improved intrinsic blue light absorption.

PROBLEM TO BE SOLVED BY THE INVENTION

As indicated above, in photothermographic materials, all of the "chemistry" for imaging is incorporated within the material itself. For example, they include a developer (that is, a reducing agent for the reducible silver ions) while conventional photographic materials usually do not. Even in so-called "instant photography", the developer chemistry is physically separated from the photosensitive silver halide until development is desired.

A problem in designing such photothermographic films is to obtain improved speed. It has been found that the incorporation of the developer into photothermographic materials requires antifoggant which, while decreasing formation of various types of "fog" or other undesirable sensitometric side effects, may adversely affect the speed, both fresh and "RSK" (Raw Stock Keeping) speed. Therefore, much effort has gone into the preparation and manufacture of photothermographic materials to minimize these problems during the preparation of the photothermographic emulsion as well as during coating, use, storage, and post-processing handling.

In particular, it is necessary that photothermographic elements be capable of maintaining its imaging properties, including speed, during storage periods. This is referred to as raw stock keeping. Ideally, film should be storage stable, under normal conditions, preferably for at least 12 months, more preferably at least 24 months or more. If a film unduly loses speed during storage, poor or unacceptable image formation can occur.

Raw stock keeping of color photothermographic films is especially a problem, compared to conventional films or even black & white photothermographic films, because at least three color records are required and all the components needed for development and image formation must be incorporated into the imaging element. Thus, there are a greater number of potentially reactive components that can prematurely react during storage. Furthermore, color photothermographic film involves radically new chemical systems, in which new and complex combinations of components may be subject to unpredictable and undesirable interactions, incompatibilities, and side reactions. The imaging chemistry must be designed to provide fast, high-quality latent image formation during image capture, but must not interact prematurely to any significant degree. Similarly, the film must be capable of fast development and high-quality image formation during thermal processing, but the same components must not prematurely interact before the processing step. This problem is particularly acute in photothermographic films, since the components of a photothermographic film are in intimate proximity, in potentially reactive association, prior to development.

There remains a need for a photothermographic film that does not exhibit any significant loss of speed during extended period of storage, subsequent to manufacture and prior to use. In particular, there is a continuing need for improving the reactivity of the compounds used to provide reducible silver ions, while at the same time providing improved raw stock keeping and low $D_{min}$ upon image formation.

SUMMARY OF THE INVENTION

The present invention is directed to a photothermographic element comprising core/shell particles each of which comprise a mixture of at least two non-photosensitive organic silver salts, which particles comprise at least one shell comprising a first organic silver salt covering a core or central portion comprising a second organic silver salt. The organic silver salt in the shell has a lower pKsp, relative to the organic silver salt in the core or central portion. The invention is alternately defined to cover core/shell particles in which a distinct core/shell boundary may not be indicated in the particle due to continuous concentration changes of the materials used to make the particle.

This invention also provides a composition comprising the core/shell particles of non-photosensitive organic silver salt. These core/shell particles can be mixed with non-photosensitive non-core/shell particles of organic silver salt, for use in a color or monochrome photothermographic element. Other components of a composition according to the present invention may comprise (in addition to non-photosensitive core/shell particles of organic silver salt) a photocatalyst, a binder, and a blocked developer and/or other reducing agent.

A preferred embodiment of this invention is a color photothermographic material comprising at least three imaging layers comprising silver halide, a blocked developer, a coupler, preferably comprising a support having thereon one or more layers comprising:

a) a non-photosensitive source of silver ions comprising core-shell particles of non-photosensitive silver salt;

b) a reducing composition for the non-photosensitive silver ions, c) a photocatalyst, and d) a binder.

This invention also comprises a method of making the core/shell non-photosensitive particles described above, which method comprises, first, preparing a dispersion of a second non-photosensitive organic silver salt from silver ions and a second silver organic coordinating ligand, and, second, preparing a first non-photosensitive organic silver salt as a shell on the second non-photosensitive silver salt by adding, in the presence of silver ions, a first silver organic coordinating ligand to the dispersion of the second non-photosensitive silver salt, the first and second silver organic coordinating ligands being different.

In one embodiment, the first organic silver ligand in the shell exhibits a pKsp difference of at least 0.5, preferably at least 1.0, more preferably at least 2.0 less than the pKsp of the second organic silver ligand. In one particularly preferred embodiment, the first organic silver ligand exhibits a cLogP of 0.1 to 10 and a pKsp of 7 to 14 and the second organic silver ligand exhibits a cLogP of 0.1 to 10 and a pKsp of 14 to 21. In another embodiment, the first organic silver salt, or salt of the first type, has a pKsp of 9 to 16 and the second organic silver salt, or the organic silver salt of the second type, has a pKsp of 12 to 19.

Both organic silver salts are present at levels above 5 g/mol of imaging silver halide. Preferably, the first organic silver salt (in the shell), which may be referred to as the silver donor (or the more reactive silver donor), which is its primary function, is present, at levels in the range of 5 to 3,000 g/mol of imaging silver halide. Preferably, the second organic silver salt (in the underlying particle) acts as the thermal fog inhibitor and is present at levels in the range of 5 to 3,000 g/mol of imaging silver halide.

Definitions of terms, as used herein, include the following:

In the descriptions of the color photothermographic materials of the present invention, "a" or "an" component refers to "at least one" of that component. For example, the core-shell silver salts described herein can be used individually or in mixtures.

Heating in a substantially water-free condition as used herein, means heating at a temperature of from about 50° to about 250° C. with little more than ambient water vapor present. The term "substantially water-free condition" means that the reaction system is approximately in equilibrium with water in the air, and water for inducing or promoting the reaction is not particularly or positively supplied from the exterior to the material. Such a condition is described in T. H. James, *The Theory of the Photographic Process*, Fourth Edition, Macmillan 1977, p 374.

"Color photothermographic material(s)" means a construction comprising at least three photothermographic emulsion layers a photothermographic set of layers of different hue and any supports, topcoat layers, blocking layers, antihalation layers, subbing or priming layers, and the like. These materials also include multilayer constructions in which one or more imaging components are in different layers, but are in "reactive association" so that they readily come into contact with each other during imaging and/or development. For example, one layer can include the non-photosensitive source of reducible silver ions and another layer can include the reducing composition, but the two reactive components are in reactive association with each other.

"Emulsion layer," "imaging layer," or "photothermographic emulsion layer," means a layer of a photothermographic material that contains the photosensitive silver halide (when used) and non-photosensitive source of reducible silver ions.

"Non-photosensitive" means not intentionally light sensitive.

The term "core/shell particle" (or alternatively, core-shell particle), as used herein, refers to a particle having at least one shell covering a core, in which the term "covering" means that the shell has a sufficient quantity of material to form at least a monolayer of molecules over the underlying particle. Similarly, in the case of a particle comprising more than one shell, each shell is defined as covering the underlying core or shell, as the case may be, by a sufficient quantity of material to form at least a monolayer of molecules. The presence of a core or shell can be inferred from the process of making the particles, including the order of addition of the organic silver salts to an underlying dispersion of particles. If the percentage of first organic silver salt, or organic silver salt of first type, in the particle is continuously varied throughout the particle, so that there is no distinct shell/core boundary or cut-off point, then the outside shell is taken to be, by default in this particular case, the first boundary, starting from the outside of the particle, when the total percent of the first organic salt, or organic silver salt of first type, in the outside shell first falls to 51 mole percent after first rising to above 51 mole percent. The term "outside shell" is defined as the outermost shell that substantially covers the underlying particle. The term "outer shell" or "inner shell" are relative terms with respect to the center or nucleus of the particle. The core/shell particles can be spherical, non-spherical, tabular, plate-like, or irregular in shape.

The term "organic silver salt" is herein meant to include salts as well as ligands comprising two ionized species. The silver salts used to make the core-shell particles are preferably comprised of silver salts of organic coordinating ligands. Many examples of such organic coordinating ligands are described below. The silver donors can comprise asymmetrical silver donors or dimers such as disclosed in commonly assigned U.S. Pat. No. 5,466,804 to Whitcomb et al. In the case of such dimers, they are considered to be two separate organic silver salts for the purpose of meeting the limitations of this invention, such that only one silver atom is attributed to each organic silver salt.

The terms "blocked developer" and "developer precursor" are the same and are meant to include developer precursors, blocked developer, hindered developers, developers with blocking and/or timing groups, wherein the term "developer" is used to indicate a reducing substance for silver ion.

*Research Disclosure* is a publication of Kenneth Mason Publications Ltd., Dudley House, 12 North Street, Emsworth, Hampshire PO10 7DQ England (also available from Emsworth Design Inc., 147 West 24th Street, New York, N.Y. 10011).

DETAILED DESCRIPTION OF THE INVENTION

As indicated above, the present invention is directed to a color or monochrome photothermographic element comprising core/shell particles of silver donor comprising at least two organic silver salts, wherein a first organic silver ligand in a shell exhibits a relatively lower pKsp than that of a second organic silver ligand in the core and/or, if present, an intermediate shell. Both organic silver salts are present at levels above 5 g/mol of silver halide in the emulsion or imaging layer. Preferably, the both the first and second organic silver salts are each present at levels in the range of 5 to 3,000 g/mol of imaging silver.

The fact that the first organic silver salt in an outside shell has a relatively low pKsp means it binds less strongly with silver, in turn meaning that it is more soluble and more reactive and more available for physical development, than would be a second organic silver salt. However, during heat development, the second organic salt in the core or inner shell becomes readily available for its purpose. Thus, the core/shell structure cooperates with temperature transition during development. The oxidatively less reactive organic silver salt, with the higher pKsp becomes active during heating, while prior to heat development, the more oxidatively reactive silver salt, with a relatively low pKsp dominates or effectively blocks the surface activity of the material in the core. In other words, the first organic silver salt functions to protect from, and decrease the extent of, the premature contact of the second organic silver salt with any other component in the imaging layer. (The interaction of the second organic silver salt with the silver halide emulsion tends to desensitize the silver halide photocatalyst).

For example, in the special case of a core/shell particle having equal amounts of the two selected organic silver salts, it is surprisingly found that the core/shell organic silver salt having the higher pKsp acts nearly the same (during heat development) as if the different organic silver salts were in separate populations of particles, notwithstanding that the core/shell particles do perform different than separate particles in terms of speed, and that it might have been expected that the lower pKsp organic silver salt in the shell might hinder or otherwise adversely affect the functioning of the higher pKsp organic silver salt during development. This shows that the core/shell particles of the present invention can provide greater stability and a higher speed, without being offset by loss of reactivity during development. In fact, it has been demonstrated that the core/shell particles of the present invention provide essentially or approximately equal sensitometry to a control when the total mole quantities of each of two organic silver salts were the same.

Without wishing to be bound by theory, it may be that the core/shell structure of the particles and their properties vary between the low temperature and high temperature exposures of the color photothermographic element. With higher temperature, the organic salts may form a mixture or coalesce, eliminating any diffusion barrier to the high pKsp material in the core.

Another advantage of the present invention is that the core/shell organic silver donor provides better flow properties and lower viscosity compared to a mixture of separate populations of the organic silver salts. There is also the manufacturing advantage of making and using a single donor material as compared to making separate emulsions.

In one embodiment of the invention, the total amount of organic silver salt in the outside shell is at least 1 mole percent of the total organic silver in the underlying particle. Also, it is preferred that the molar ratio of total organic silver salt in the outside shell to total organic silver salt in the underlying particle is about 0.1:10 to about 10:1.

In a preferred embodiment of the present invention, a color photothermographic element has on a support at least three light-sensitive color imaging layers which have their individual sensitivities in different wavelength regions, each of said imaging layers comprising a light-sensitive silver emulsion, a binder, a dye-providing coupler, and a developer or blocked developer, the dyes formed from the dye-providing couplers in the layers being different in hue, therefore capable of forming at least three dye images of different visible or non-visible colors. By the term "visible or non-visible colors" is meant that one or more IR "colors" may be used for image formation in the photothermographic element.

In one embodiment of the invention, at least one imaging layer in the element comprises core/shell particles of non-light sensitive organic silver salts, the particles comprising (i) an outside shell comprising at least one organic silver salt, and (ii) under the outside shell, an underlying particle that comprises a core comprising at least one organic silver salt and, optionally, one or more intermediate shells each comprising at least one organic silver salt, wherein the organic silver salt in the outside shell comprises a first organic silver salt and the organic silver salt in the underlying particle comprises a second organic silver salt, the pKsp of said first organic silver salt being at least 0.5 lower than the pKsp of said second organic silver salt. Preferably, molar ratio of said first organic silver salt to said second organic silver salt is from about 0.1:10 to about 10:1.

In another embodiment of the invention, at least one imaging layer comprises core/shell particles of non-light sensitive organic silver salts, the particles comprising (i) an outside shell comprising at least one organic silver salt, and (ii) under the outside shell, an underlying particle that comprises a core comprising at least one organic silver salt and, optionally, one or more intermediate shells each comprising at least one organic silver salt, wherein greater than 50 mole percent (preferably greater than 60 percent) of organic silver salt in the outside shell comprises one or more organic silver salts of a first type and greater than 50 mole percent (preferably greater than 60 mole percent) of organic silver salt in the underlying particle comprises one or more organic silver salts of a second type, and wherein the pKsp of said organic silver salt of the first type is at least 0.5 lower than the pKsp of said organic silver salt of a second type. Preferably, the molar ratio, in the core/shell particle, of the organic silver salt of a first type to the organic silver salt of a second type can be calculated to be 01:10 to about 10:1.

It is possible for an organic silver salt present in the particle to not be assigned to either the first type or the second type. For example, this may occur if an organic silver salt has an intermediate pKsp within the minimum difference (for example, 0.5) between the pKsp of the first and second type of organic silver salts. It is also possible for an organic silver salt to be optionally assigned to either one or the other type, based solely on pKsp differences, for example if all the differences in pKsp among the different salts are greater than the minimum difference, for example 0.5. However, for purposes of claim coverage, assignments of organic silver salts are made in order to meet, if possible, the claim limitations, including the 50 mole percent claim limitations, of the present invention.

In yet another embodiment of the invention, at least one imaging layer of the element comprises at least one imaging layer comprising "core/shell" type of particles of non-light sensitive organic silver salts, the particles comprising a first type of organic silver salt and a second type of organic silver salt, wherein greater than 50, more preferably greater than 60 mole percent, of the organic silver salt in the particle that is of a first type overlies greater than 50 mole percent, more preferably greater than 60 percent, of the organic silver salt in the particle that is of a second type, wherein the pKsp of said organic silver salt of the first type is at least 0.5 lower than the pKsp of said organic silver salt of a second type. By "overlies" in this context is meant further from the nucleus of the particle. This corresponds to the overlying organic silver salt being added to the growing particle at a later time than the organic silver salt it overlies. In other words, if one were to plot time versus rate of addition of a first and second organic salt in forming the core/shell particle, the center of gravity of the first plot (corresponding to the rate of addition of addition of the first organic salt) is outside (farther along the time axis) than the center of gravity of the other plot (corresponding to the rate of addition of addition of the second organic salt). This embodiment of core/shell particles does not require distinct shells, and may instead involve continuous gradients of the various organic silver salts from nucleus to surface or from start to end of particle growth. Preferably, in an outermost portion of the particle encompassing 50 mole percent portion of the organic silver salt in the particle, greater than 50 mole percent of the organic silver salt of a first type overlies greater than 50 mole percent of the organic silver salt in the outermost portion that is of a second type.

In one particular embodiment of the invention, a core/shell particle simply comprises a core and a single shell. In any of the core/shell particles of the present invention, there can be only two organic silver salts or there can be more than two organic silver salts. In the case of a particle with a single shell and only two different organic silver salts, the mole percent of the first organic salt in the outside shell is substantially greater that the mole percent of any second organic salt in the outside shell, and the mole percent of the first organic salt in the outside shell is substantially greater than the mole percent of the first organic salt in the core.

Of course, the core/shell particles can comprise two, three, four, five or more shells. For example, one embodiment of the invention involves a core/inner shell/outer shell structure, in which a second (outer) shell comprises a third organic silver salt, or the same organic salt as in the core, is used. This may be advantageous, for example, when the material in the first (inner) shell is relatively more desensitizing than the material in the second (outer) shell. A thin skin of the same organic silver salt as in the core can reduce the amount of dye adsorbed to the surface of the outer shell, thus providing passivation to the particle.

The core/shell particles can be used in one or more imaging layers, only in imaging layers of a certain color, or in all imaging layers. Different core/shell donors in different color records of the imaging element can be used. Combinations of different core/shell donors in the same imaging layer can also be used.

Although the minimum value of the indicated difference in pKsp is 0.5, preferably the difference in pKsp is at least 1.0, more preferably at least 2.0. The lower the temperature onset, however, the less the difference in pKsp that is needed. In one embodiment of the invention, both the first and second organic silver salt, or both the first and second type of organic silver salt, have a pKsp of greater than 11, preferably greater than 12, and neither are silver carboxylates, including silver behenate.

The activity solubility product or $pK_{sp}$ of an organic silver salt is a measure of its solubility in water. Some organic silver salts are only sparingly soluble and their solubility products are disclosed, for example, in Chapter 1 pages 7–10 of *The Theory of the Photographic Process*, by T. H. James, Macmillan Publishing Co. Inc., New Your (fourth edition 1977). Many of the organic silver salts consist of the replacement of a ligand proton with Ag+. The silver salts derived from mercapto compounds are relatively less soluble. The compound PMT has a $pK_{sp}$ of 16.2 at 25° C. as reported by Z. C. H. Tan et al., *Anal. Chem.*, 44, 411 (1972); Z. C. H. Tan, *Phototgr. Sci. Eng.*, 19, 17 (1975). In comparison, benzotriazole, for example, has a $pK_{sp}$ of 13.5 at a temperature of 25° C. as reported by C. J. Battaglia, *Photogr. Sci. Eng.*, 14, 275 (1970).

In a preferred embodiment, the primary source of reducible, non-photosensitive silver in the practice of this invention are the core-shell organic silver salts described as having the lower pKsp. In some embodiments, the core or underlying particle can comprise a mixture of two or more different silver salts, or one or more of the shells can comprise a mixture of two or more different silver salts, or both the core/underlying particle and one or more shells can all comprise mixtures of two or more different organic silver salts. Preferably, however, at least one silver salt in the core/underlying particle is different, with respect to pKsp from at least one silver salt in the outside shell.

In still other embodiments, a core can be comprised of one or more silver salts, an "inner" shell can be comprised of one or more different silver salts, and an "outer" shell can be comprised of one or more of silver salts that are the same or different as those in the core. Further still, the "inner" and "outer" shells can be composed of the same mixture of silver salt(s), but have different molar ratios of the salts in those mixtures. Additionally, the transition between the surface layer (shell) and internal phase (core) of the non-photosensitive core-shell silver salt may be abrupt, so as to provide a distinct boundary, or diffuse so as to create a gradual transition from one non-photosensitive silver salt to another.

Other compositions useful in this invention can include one or more core-shell particles of organic silver salts as described above and one or more conventional non-core-shell particles of organic silver salts, which types of particles can be mixed together in the same imaging layer Methods for preparing the core-shell silver salts of the present invention as well as for preparing photosensitive dispersions containing them will now be described. In one embodiment a method of making the core-shell non-photosensitive silver salt comprises:

A) preparing a dispersion of comprising a non-photosensitive second organic silver salt from silver ions and a second organic coordinating ligand for silver, wherein the second organic salt has a relatively high pKsp, and B) forming, by precipitation, at least one shell, comprising a non-photosensitive first organic silver salt, on said second non-photosensitive organic silver salt, in the presence of silver ions, by adding first silver organic coordinating ligand to said dispersion comprising said non-photosensitive second organic silver salt, wherein the first organic salt has a relatively low pKsp, said first and second organic coordinating ligands being different compounds, and the pKsp of both salts are greater than 11.

Typically, therefore, shells are determined by the order of addition, the shell material being introduced after the core material. In another embodiment, it is possible to have a gradient, by mixing streams. Thus, the boundary between the core and shell of the non-photosensitive silver salts need not be discrete but may be continuous and the ratio of said first and second silver organic coordinating ligands may continuously decrease as the distance from the center of the core increases. As indicated above, if the percentage of first organic silver salt, or organic silver salt of first type, in the particle is continuously varied throughout the particle, so that there is no distinct shell/core boundary or cut-off point, then the "outside shell" inner boundary, in this particular case, is taken to be the first boundary, starting from the outside of the particle, when the total percent of the first organic salt, or organic silver salt of first type, in the outside shell first falls to 51 mole percent after first rising to above 51 mole percent. Thus, in such case (where there is no distinct boundary for the outside shell), the outside shell by definition comprises 51 percent of the first organic salt, or organic silver salt of the first type.

The term "outside shell" is, in general, defined as the outermost shell that substantially covers the underlying particle. The term "outer shell" or "inner shell" are relative terms with respect to the center or nucleus of the particle. The core/shell particles can be spherical, non-spherical, tabular, plate-like, or irregular in shape.

The invention is also directed to a composition comprising a hydrophilic or hydrophobic binder in combination with a core/shell non-photosensitive silver salt as described above, wherein the pKsp of the first organic silver salt is at least 1.0 lower than the pKsp of the second organic silver salt; and the pKsp of both salts are greater than 11. Such compositions can further comprise a reducing agent for said non-photosensitive silver ions, and/or photocatalyst such as a silver halide or a mixture of silver halides.

It should be noted that although reference is made to a core/shell structure, there may be some renucleation or conversion during preparation. In any case, however, particle analysis and micrographs can indicate a core/shell structure, EDS (energy dispersive spectroscopy), which provides compositional information for sulfur and silver, confirms a core/shell. EDS data shows the first organic silver salt going to the surface of the second organic silver salt, not forming two separate populations of particles. The core/shell particles of this invention are defined in terms of cores and shells ideally corresponding to the times and amounts of precipitation of the organic silver salt or salts during the formation of the core/shell particle.

When used in photothermographic emulsions, the non-photosensitive core-shell silver salts can be prepared at various stages of preparation of the photothermographic emulsion. Preferably, the non-photosensitive core-shell particles are prepared before the addition of preformed silver halide grains.

The first organic silver salt, or first type of organic silver salt, is preferably a non-photosensitive source of reducible silver ions (that is, silver salts) and can be any compound that contains reducible silver (1+) ions. Preferably, it is a silver salt that is comparatively stable to light and forms a silver image when heated to 50° C. or higher in the presence of an exposed photocatalyst (such as silver halide) and a reducing composition. In the imaging layer of the element, the photocatalyst and the non-photosensitive source of reducible silver ions must be in catalytic proximity (that is, reactive association). "Catalytic proximity" or "reactive association" means that they should be in the same layer, or in adjacent layers. It is preferred that these reactive components be present in the same emulsion layer.

According to the present invention, the organic silver salt referred to as the "organic silver donor" or "the first organic silver salt" or "organic silver salt of the first type") is generally the oxidatively more reactive organic silver salt (respectively, compared to the second organic silver salt or second type of organic silver salt. This more reactive organic silver salt is preferably a silver salt of a nitrogen acid (imine) group, which can optionally be part of the ring structure of a heterocyclic compound. Aliphatic and aromatic carboxylic acids such as silver behenate or silver benzoate, in which the silver is associated with the carboxylic acid moiety, are specifically excluded as the organic silver donor compound. Compounds that have both a nitrogen acid moiety and carboxylic acid moiety are included as donors of this invention only insofar as the silver ion is associated with the nitrogen acid rather than the carboxylic acid group. The donor can also contain a mercapto residue, provided that the sulfur does not bind silver too strongly, and is preferably not a thiol or thione compound.

More preferably, a silver salt of a compound containing an imino group present in a heterocyclic nucleus can be used. Typical preferred heterocyclic nuclei include triazole, oxazole, thiazole, thiazoline, imidazoline, imidazole, diazole, pyridine and triazine. Examples of the first organic silver salt include derivatives of a tetrazole. Specific examples include but are not limited to 1H-tetrazole, 5-ethyl-1H-tetrazole, 5-amino-1H-tetrazole, 5-4'methoxyphenyl-1H-tetrazole, and 5-4'carboxyphenyl-1H-tetrazole.

The organic silver salt may also be a derivative of an imidazole. Specific examples include but are not limited to benzimidazole, 5-methyl-benzimidazole, imidazole, 2-methyl-benzimidazole, and 2-methyl-5-nitro-benzimidazole. The organic silver salt may also be a derivative of a pyrazole. Specific examples include but are not limited to pyrazole, 3,4-methyl-pyrazole, and 3-phenyl-pyrazole.

The organic silver salt may also be a derivative of a triazole. Specific examples include but are not limited to benzotriazole, 1H-1,2,4-trazole, 3-amino-1,2,4 triazole, 3-amino-5-benzylmercapto-1,2,4-triazole, 5,6-dimethyl benzotriazole, 5-chloro benzotriazole, and 4-nitro-6-chloro-benzotriazole.

Other silver salts of nitrogen acids may also be used. Examples would include but not be limited to o-benzoic sulfimide, 4-hydroxy-6-methyl-1,3,3A,7-tetraazaindene, 4-hydroxy-6-methyl-1,2,3,3A,7-pentaazaindene, urazole, and 4-hydroxy-5-bromo-6-methyl-1,2,3,3A,7-pentaazaindene.

Most preferred examples of the organic silver donor compounds include the silver salts of benzotriazole, triazole, and derivatives thereof, as mentioned above and also described in Japanese patent publications 30270/69 and 18146/70, for example a silver salt of benzotriazole or methylbenzotriazole, etc., a silver salt of a halogen substituted benzotriazole, such as a silver salt of 5-chlorobenzotriazole, etc., a silver salt of 1,2,4-triazole, a silver salt of 3-amino-5-mercaptobenzyl-1,2,4-triazole, a silver salt of 1H-tetrazole as described in U.S. Pat. No. 4,220,709.

Silver salt complexes may be prepared by mixture of aqueous solutions of a silver ionic species, such as silver nitrate, and a solution of the organic ligand to be complexed with silver. The mixture process may take any convenient form, including those employed in the process of silver halide precipitation. A stabilizer may be used to avoid flocculation of the silver complex particles. The stabilizer may be any of those materials known to be useful in the photographic art, such as, but not limited to, gelatin, polyvinyl alcohol or polymeric or monomeric surfactants.

The photosensitive silver halide grains and the organic silver salt are coated so that they are in catalytic proximity during development. They can be coated in contiguous layers, but are preferably mixed prior to coating. Conventional mixing techniques are illustrated by *Research Disclosure*, Item 17029, cited above, as well as U.S. Pat. No. 3,700,458 and published Japanese patent applications Nos. 32928/75, 13224/74, 17216/75 and 42729/76.

Preferably, at least one organic silver donor is selected from one of the above-described compounds.

In a preferred embodiment, an oxidatively less reactive silver salt (the "second organic silver salt" or organic silver salt of the second type"), for example in the core, is selected from silver salts of thiol or thione substituted compounds having a heterocyclic nucleus containing 5 or 6 ring atoms, at least one of which is nitrogen, with other ring atoms including carbon and up to two hetero-atoms selected from among oxygen, sulfur and nitrogen are specifically contemplated. Typical preferred heterocyclic nuclei include triazole, oxazole, thiazole, thiazoline, imidazoline, imidazole, diazole, pyridine and triazine. Preferred examples of these heterocyclic compounds include a silver salt of 2-mercaptobenzimidazole, a silver salt of 2-mercapto-5-aminothiadiazole, a silver salt of 5-carboxylic-1-methyl-2-phenyl-4-thiopyridine, a silver salt of mercaptotriazine, a silver salt of 2-mercaptobenzoxazole. These silver salts are herein referred to as "oxidatively less reactive silver salts."

The oxidatively less reactive silver salt may be a derivative of a thionanide. Specific examples would include but not be limited to the silver salts of 6-chloro-2-mercapto benzothiazole, 2-mercapto-thiazole, naptho(1,2-d)thiazole-2(1H)-thione, 4-methyl-4-thiazoline-2-thione, 2-thiazolidinethione, 4,5-dimethyl-4-thiazoline-2-thione, 4-methyl-5-carboxy-4-thiazoline-2-thione, and 3-(2-carboxyethyl)-4-methyl-4-thiazoline-2-thione.

Preferably, the oxidatively less reactive silver salt is a derivative of a mercapto-triazole. Specific examples would include, but not be limited to, a silver salt of 3-mercapto-4-phenyl-1,2,4 triazole and a silver salt of 3-mercapto-1,2,4-triazole.

Most preferably the oxidatively less reactive silver salt is a derivative of a mercapto-tetrazole. In one preferred embodiment, a mercapto tetrazole compound useful in the present invention is represented by the following structure:

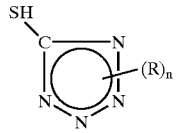

wherein n is 0 or 1, and R is independently selected from the group consisting of substituted or unsubstituted alkyl, aralkyl, or aryl. Substituents include, but are not limited to, C1 to C6 alkyl, nitro, halogen, and the like, which substituents do not adversely affect the thermal fog inhibiting effect of the silver salt. Preferably, n is 1 and R is an alkyl having 1 to 16 carbon atoms or a substituted or unsubstituted phenyl group. Specific examples include but are not limited to silver salts of 1-phenyl-5-mercapto-tetrazole, 1-(3-acetamido)-5-mercapto-tetrazole, or 1-[3-(2-sulfo)benzamidophenyl]-5-mercapto-tetrazole.

In one embodiment of the invention, a first organic silver salt in the shell is a benzotriazole or derivative thereof and a second organic silver salt in the core is a mercapto-functional compound, preferably mercapto-heterocyclic compound. Particularly preferred is 1-phenyl-5-mercapto-tetrazole (PMT).

In general, an organic silver salt is formed by mixing silver nitrate and other salts with the free base of the organic ligand such as PMT. By raising the pH sufficiently with alkaline base, the silver salt of PMT can be precipitated, typically in spheroids 20 nm in diameter and larger.

As indicated above, a preferred embodiment of the invention relates to a dry photothermographic process employing blocked developers that decompose (i.e., unblock) on thermal activation to release a developing agent. In dry processing embodiments, thermal activation preferably occurs at temperatures between about 80 to 180° C., preferably 100 to 160° C.

By a "dry thermal process" or "dry photothermographic" process is meant herein a process involving, after imagewise exposure of the photographic element, developing the resulting latent image by the use of heat to raise the temperature of the photothermographic element or film to a temperature of at least about 80° C., preferably at least about 100° C., more preferably at about 120° C. to 180° C., without liquid processing of the film, preferably in an essentially dry process without the application of aqueous solutions. By an essentially dry process is meant a process that does not involve the uniform saturation of the film with a liquid, solvent, or aqueous solution. Thus, contrary to photothermographic processing involving low-volume liquid processing, the amount of water required is less than 1 times, preferably less than 0.4 times and more preferably less than 0.1 times the amount required for maximally swelling total coated layers of the film excluding a back layer. Most preferably, no liquid is required or applied added to the film during thermal treatment. Preferably, no laminates are required to be intimately contacted with the film in the presence of aqueous solution.

Preferably, during thermal development an internally located blocked developing agent in reactive association with each of three light-sensitive units becomes unblocked to form a developing agent, whereby the unblocked developing agent is imagewise oxidized on development and this oxidized form reacts with the dye-providing couplers to form a dye and thereby a color image. While the formed image can be a positive working or negative working image, a negative working image is preferred.

The components of the photothermographic element can be in any location in the element that provides the desired image. If desired, one or more of the components can be in one or more layers of the element. For example, in some cases, it is desirable to include certain percentages of the reducing agent, toner, thermal solvent, stabilizer and/or other addenda in the overcoat layer over the photothermographic image recording layer of the element. This, in some cases, reduces migration of certain addenda in the layers of the element.

It is necessary that the components of the photographic combination be "in association" with each other in order to produce the desired image. The term "in association" herein means that in the photothermographic element the photographic silver halide and the image-forming combination are in a location with respect to each other that enables the desired processing and forms a useful image. This may include the location of components in different layers.

Preferably, development processing is carried out (i) for less than 60 seconds, (ii) at the temperature from 120 to 180° C., and (iii) without the application of any aqueous solution.

Dry thermal development of a color photothermographic film for general use with respect to consumer cameras provides significant advantages in processing ease and convenience, since they are developed by the application of heat without wet processing solutions. Such film is especially amenable to development at kiosks, with the use of essentially dry equipment. Thus, it is envisioned that a consumer could bring an imagewise exposed photothermographic film, for development and printing, to a kiosk located at any one of a number of diverse locations, optionally independent from a wet-development lab, where the film could be developed and printed without requiring manipulation by third-party technicians. It is also envisioned that a consumer could own and operate such film development equipment at home, particularly since the system is dry and does not involve the application and use of complex or hazardous chemicals. Thus, the dry photothermographic system opens up new opportunities for greater convenience, accessibility, and speed of development (from the point of image capture by the consumer to the point of prints in the consumer's hands), even essentially "immediate" development in the home for a wide cross-section of consumers.

By kiosk is meant an automated free-standing machine, self-contained and (in exchange for certain payments or credits) capable of developing a roll of imagewise exposed film on a roll-by-roll basis, without requiring the intervention of technicians or other third-party persons such as necessary in wet-chemical laboratories. Typically, the customer will initiate and control the carrying out of film processing and optional printing by means of a computer interface. Such kiosks typically will be less than 6 cubic meters in dimension, preferably about 3 cubic meters or less in dimension, and hence commercially transportable to diverse locations. Such kiosks may optionally comprise a heater for color development, a scanner for digitally recording the color image, and a device for transferring the color image to a display element.

Assuming the availability and accessibility of such kiosks, such photothermographic films could potentially be developed at any time of day, "on demand," in a matter minutes, without requiring the participation of third-party processors, multiple-tank equipment and the like. Such photothermographic processing could potentially be done on an "as needed" basis, even one roll at a time, without necessitating the high-volume processing that would justify, in a commercial setting, equipment capable of high-throughput. The kiosks thus envisioned would be capable of heating the film to develop a negative color image and then subsequently scanning the film on an individual consumer basis, with the option of generating a display element corresponding to the developed color image. Details of useful scanning and image manipulation schemes are disclosed in co-filed and commonly assigned U.S. Ser. No. 09/592,836 and U.S. Ser. No. 09/592,816, both hereby incorporated by reference in their entirety.

In view of advances in the art of scanning technologies, it has now become natural and practical for photothermographic color films such as disclosed in EP 0762 201 to be scanned, which can be accomplished without the necessity of removing the silver or silver-halide from the negative, although special arrangements for such scanning can be made to improve its quality. See, for example, Simons U.S. Pat. No. 5,391,443. Method for the scanning of such films are also disclosed in commonly assigned U.S. Ser. No. 09,855,046 and U.S. Ser. No. 09,855,051, hereby incorporated by reference in their entirety.

Once distinguishable color records have been formed in the processed photographic elements, conventional techniques can be employed for retrieving the image information for each color record and manipulating the record for subsequent creation of a color balanced viewable image. For example, it is possible to scan the photographic element successively within the blue, green, and red regions of the spectrum or to incorporate blue, green, and red light within a single scanning beam that is divided and passed through blue, green, and red filters to form separate scanning beams for each color record. If other colors are imagewise present in the element, then appropriately colored light beams are employed. A simple technique is to scan the photographic element point-by-point along a series of laterally offset parallel scan paths. A sensor that converts radiation received into an electrical signal notes the intensity of light passing through the element at a scanning point. Most generally this electronic signal is further manipulated to form a useful electronic record of the image. For example, the electrical signal can be passed through an analog-to-digital converter and sent to a digital computer together with location information required for pixel (point) location within the image. The number of pixels collected in this manner can be varied as dictated by the desired image quality. Very low resolution images can have pixel counts of 192×128 pixels per film frame, low resolution 384×256 pixels per frame, medium resolution 768×512 pixels per frame, high resolution 1536×1024 pixels per frame and very high resolution 3072×2048 pixels per frame or even 6144×4096 pixels per frame or even more. Higher pixel counts or higher resolution translates into higher quality images because it enables higher sharpness and the ability to distinguish finer details especially at higher magnifications at viewing. These pixel counts relate to image frames having an aspect ratio of 1.5 to 1. Other pixel counts and frame aspect ratios can be employed as known in the art. Most generally, a difference of four times between the number of pixels rendered per frame can lead to a noticeable difference in picture quality, while differences of sixteen times or sixty four times are even more preferred in situations where a low quality image is to be presented for approval or preview purposes but a higher quality image is desired for final delivery to a customer. On digitization, these scans can have a bit depth of between 6 bits per color per pixel and 16 bits per color per pixel or even more. The bit depth can preferably be between 8 bits and 12 bits per color per pixel. Larger bit depth translates into higher quality images because it enables superior tone and color quality.

The electronic signal can form an electronic record that is suitable to allow reconstruction of the image into viewable forms such as computer monitor displayed images, television images, optically, mechanically or digitally printed images and displays and so forth all as known in the art. The formed image can be stored or transmitted to enable further manipulation or viewing, such as in U.S. Ser. No. 09/592,816 titled AN IMAGE PROCESSING AND MANIPULATION SYSTEM to Richard P. Szajewski, Alan Sowinski and John Buhr.

The retained silver halide in photothermographically developed film, however, can scatter light, decrease sharpness and raise the overall density of the film, thus leading to impaired scanning. Further, retained silver halide can print-out to ambient/viewing/scanning light, render non-imagewise density, degrade signal-to noise of the original scene, and raise density even higher. Finally, the retained silver halide and organic silver salt can remain in reactive association with the other film chemistry, making the film unsuitable as an archival media. Removal or stabilization of these silver sources are necessary to render the photothermographic film to an archival state.

Furthermore, the silver coated in the photothermographic film (silver halide, silver donor, and metallic silver) is unnecessary to the dye image produced, and this silver is valuable and the desire is to recover it is high. In black and white embodiments of the invention, retention of the metallic silver is required for maintaining the image. In other monochrome embodiments of the invention, the image is retained in dye, in which case the metallic silver is no longer required. Examples of black & white and monochrome photothermographic elements are described, for example, in commonly assigned U.S. Pat. No. 5,466,804 and U.S. Ser. No. 09/761,954; hereby incorporated by reference in their entirety.

Thus, it may be desirable to remove, in subsequent processing steps, one or more of the silver containing components of the film: the silver halide, one or more silver donors, the silver-containing thermal fog inhibitor if present, and/or the silver metal. The three main sources are the developed metallic silver, the silver halide, and the silver donor. Alternately, it may be desirable to stabilize the silver halide in the photothermographic film. Silver can be wholly or partially stabilized/removed based on the total quantity of silver and/or the source of silver in the film.

The removal of the silver halide and silver donor can be accomplished with a common fixing chemical as known in the photographic arts. Specific examples of useful chemicals include: thioethers, thioureas, thiols, thiones, thionamides, amines, quaternary amine salts, ureas, thiosulfates, thiocyanates, bisulfites, amine oxides, iminodiethanol-sulfur dioxide addition complexes, amphoteric amines, bis-sulfonylmethanes, and the carbocyclic and heterocyclic derivatives of these compounds. These chemicals have the ability to form a soluble complex with silver ion and transport the silver out of the film into a receiving vehicle. The receiving vehicle can be another coated layer (laminate) or a conventional liquid processing bath. Laminates useful for fixing films are disclosed in U.S. Ser. No. 09/593,049, hereby incorporated by reference in their entirety. Automated systems for applying a photochemical processing solution to a film via a laminate are disclosed in U.S. Ser. No. 09/593,097.

The stabilization of the silver halide and silver donor can also be accomplished with a common stabilization chemical. The previously mentioned silver salt removal compounds can be employed in this regard. Such chemicals have the ability to form a reactively stable and light-insensitive compound with silver ion. With stabilization, the silver is not necessarily removed from the film, although the fixing agent and stabilization agents could very well be a single chemical. The physical state of the stabilized silver is no longer in large (>50 nm) particles as it was for the silver halide and silver donor, so the stabilized state is also advantaged in that light scatter and overall density is lower, rendering the image more suitable for scanning.

The removal of the metallic silver is more difficult than removal of the silver halide and silver donor. In general, two reaction steps are involved. The first step is to bleach the metallic silver to silver ion. The second step may be identical to the removal/stabilization step(s) described for silver halide and silver donor above. Metallic silver is a stable state that does not compromise the archival stability of the photothermographic film. Therefore, if stabilization of the photothermographic film is favored over removal of silver, the bleach step can be skipped and the metallic silver left in the film. In cases where the metallic silver is removed, the bleach and fix steps can be done together (called a blix) or sequentially (bleach+fix).

The process could involve one or more of the scenarios or permutations of steps. The steps can be done one right after another or can be delayed with respect to time and location. For instance, heat development and scanning can be done in a remote kiosk, then bleaching and fixing accomplished several days later at a retail photofinishing lab. In one embodiment, multiple scanning of images is accomplished. For example, an initial scan may be done for soft display or a lower cost hard display of the image after heat processing, then a higher quality or a higher cost secondary scan after stabilization is accomplished for archiving and printing, optionally based on a selection from the initial display.

For illustrative purposes, a non-exhaustive list of photothermographic film processes involving a common dry heat development step are as follows:

1. heat development=>scan=>stabilize (for example, with a laminate)=>scan=>obtain returnable archival film.
2. heat development=>fix bath=>water wash=>dry=>scan=>obtain returnable archival film
3. heat development=>scan=>blix bath=>dry=>scan=>recycle all or part of the silver in film
4. heat development=>bleach laminate=>fix laminate=>scan=>(recycle all or part of the silver in film)
5. heat development=>bleach=>wash=>fix=>wash=>dry=>relatively slow, high quality scan Other schemes will be apparent to the skilled artisan.

The process of the present invention preferably employs films that are backwards compatible with traditional wet-chemical processing. This is because thermal processing may not (at least initially) be as accessible as conventional C-41 processing, which are widely available as a mature industry standard. The unavailability of thermal processors and associated equipment can hinder the adoption of dry photothermographic films by the consumer. For example, accessibility of thermal processors or processing may vary with the geographical location of different consumers or the same consumer at different times. Photothermographic films that can also be processed by C-41 chemistry or the equivalent overcomes this disadvantage or problem.

Thus, photothermographic films that are backwards compatible are preferred, at least initially during commercialization, in order to permit the consumer to enjoy the benefits unique to thermal processing (kiosk processing, low environmental impact, and the like) when thermal processing is accessible, but also allow the consumer to take advantage of the current ubiquity of C-41 processing when thermal processing may not be accessible. Consequently, the film can be designed so that the consumer who submits the film for development can make the choice of either color development route described above. (In one embodiment of the invention, the blocked developing agent in the photothermographic film, after being unblocked, may be the same compound as the non-blocked developing agent.) Thus, a dry photothermographic system can be made backwards compatible for use with a conventional wet-development process.

Photothermographic films containing other specified blocked development inhibitors that modify curve shape in the thermal process, but do not inhibit in the trade process (not unblocked) are disclosed in commonly assigned U.S. Ser. No. 09/746,050, hereby incorporated by reference in its entirety. This allows for backward process compatible photothermographic film with improved tone scale, including control of the D/logH curve without latitude reduction by non-imagewise thermal release of the blocked development inhibitors. Again, these blocked inhibitors are not released in C-41 processing or the like.

Photographic elements designed to be processed thermally (involving dry physical development processes) and then scanned may be designed to achieve different responses to optically printed film elements. The dye image characteristic curve gamma is generally lower than in optically printed film elements, so as to achieve an exposure latitude of at least 2.7 log E, which is a minimum acceptable exposure latitude of a multicolor photographic element. An exposure latitude of at least 3.0 log E is preferred, since this allows for a comfortable margin of error in exposure level selection by a photographer. Even larger exposure latitudes are specifically preferred, since the ability to obtain accurate image reproduction with larger exposure errors is realized. Whereas in color negative elements intended for printing, the visual attractiveness of the printed scene is often lost when gamma is exceptionally low, when color negative elements are scanned to create digital dye image records, contrast can be increased by adjustment of the electronic signal information. For this reason, it is advantageous to control the gamma of the film to be scanned by emulsion design, laydown or coupler laydown to give two examples of useful methods, known in the art. If the film element is also to be processed using an aqueous development (chemical development process) such as is used for conventional or rapid access films, for example KODAK C-41, the gamma obtained may be further suppressed and be too low to be effectively scanned, such that the signal to noise of the photographic response is less than desired. It is therefore advantageous to design the film to be processed in either system, thermal or aqueous prior to scanning. The action of blocked inhibitors are active in reducing the gamma of the thermally developed film, but when the same film is alternatively processed in an aqueous medium, they have only a minimal effect. In this way they help create similarly good sensitometric responses from each development protocol, that can be scanned. The blocked inhibitors release inhibitor thermally at rates that make them effective as contrast controllers. When processed in an aqueous system, where hydrolysis rather than thermal elimination is the chemical process for inhibitor release, (a) the release may still occur, but the inhibitor released is too weak in the aqueous system to have a major effect on the developing silver halide, or (b) the release does not occur adequately within the time-scale of development. The blocked inhibitor may be too hydrophobic and so for solubility reasons will not be available to the aqueous phase, or the rate of hydrolysis may be too slow.

A typical color negative film construction useful in the practice of the invention is illustrated by the following element, SCN-1:

| ELEMENT SCN-1 | |
|---|---|
| SOC | Surface Overcoat |
| BU | Blue Recording Layer Unit |
| IL1 | First Interlayer |
| GU | Green Recording Layer Unit |
| IL2 | Second Interlayer |
| RU | Red Recording Layer Unit |
| AHU | Antihalation Layer Unit |
| S | Support |
| SOC | Surface Overcoat |

The support S can be either reflective or transparent, which is usually preferred. When reflective, the support is white and can take the form of any conventional support currently employed in color print elements. When the support is transparent, it can be colorless or tinted and can take the form of any conventional support currently employed in color negative elements—e.g., a colorless or tinted transparent film support. Details of support construction are well understood in the art. Examples of useful supports are poly(vinylacetal) film, polystyrene film, poly (ethyleneterephthalate) film, poly(ethylene naphthalate) film, polycarbonate film, and related films and resinous materials, as well as paper, cloth, glass, metal, and other supports that withstand the anticipated processing conditions. The element can contain additional layers, such as filter layers, interlayers, overcoat layers, subbing layers, antihalation layers and the like. Transparent and reflective support constructions, including subbing layers to enhance adhesion, are disclosed in Section XV of *Research Disclosure I*.

Photographic elements of the present invention may also usefully include a magnetic recording material as described in *Research Disclosure*, Item 34390, November 1992, or a transparent magnetic recording layer such as a layer containing magnetic particles on the underside of a transparent support as in U.S. Pat. No. 4,279,945, and U.S. Pat. No. 4,302,523.

Each of blue, green and red recording layer units BU, GU and RU are formed of one or more hydrophilic colloid layers and contain at least one radiation-sensitive silver halide emulsion and coupler, including at least one dye image-forming coupler. It is preferred that the green, and red recording units are subdivided into at least two recording layer sub-units to provide increased recording latitude and reduced image granularity. In the simplest contemplated construction each of the layer units or layer sub-units consists of a single hydrophilic colloid layer containing emulsion and coupler. When coupler present in a layer unit or layer sub-unit is coated in a hydrophilic colloid layer other than an emulsion containing layer, the coupler containing hydrophilic colloid layer is positioned to receive oxidized color developing agent from the emulsion during development. Usually the coupler containing layer is the next adjacent hydrophilic colloid layer to the emulsion containing layer.

In order to ensure excellent image sharpness, and to facilitate manufacture and use in cameras, all of the sensitized layers are preferably positioned on a common face of the support. When in spool form, the element will be spooled such that when unspooled in a camera, exposing light strikes all of the sensitized layers before striking the face of the support carrying these layers. Further, to ensure excellent sharpness of images exposed onto the element, the total thickness of the layer units above the support should be controlled. Generally, the total thickness of the sensitized layers, interlayers and protective layers on the exposure face of the support are less than 35 μm.

Any convenient selection from among conventional radiation-sensitive silver halide emulsions can be incorporated within the layer units and used to provide the spectral absorptances of the invention. Most commonly high bromide emulsions containing a minor amount of iodide are employed. To realize higher rates of processing, high chloride emulsions can be employed. Radiation-sensitive silver chloride, silver bromide, silver iodobromide, silver iodochloride, silver chlorobromide, silver bromochloride, silver iodochlorobromide and silver iodobromochloride grains are all contemplated. The grains can be either regular or irregular (e.g., tabular). Tabular grain emulsions, those in which tabular grains account for at least 50 (preferably at least 70 and optimally at least 90) percent of total grain projected area are particularly advantageous for increasing speed in relation to granularity. To be considered tabular a grain requires two major parallel faces with a ratio of its equivalent circular diameter (ECD) to its thickness of at least 2. Specifically preferred tabular grain emulsions are those having a tabular grain average aspect ratio of at least 5 and, optimally, greater than 8. Preferred mean tabular grain thickness are less than 0.3 μm (most preferably less than 0.2 μm). Ultra thin tabular grain emulsions, those with mean tabular grain thickness of less than 0.07 μm, are specifically contemplated. The grains preferably form surface latent images so that they produce negative images when processed in a surface developer in color negative film forms of the invention.

Illustrations of conventional radiation-sensitive silver halide emulsions are provided by *Research Disclosure I*, cited above, I. Emulsion grains and their preparation. Chemical sensitization of the emulsions, which can take any conventional form, is illustrated in section IV. Chemical sensitization. Compounds useful as chemical sensitizers, include, for example, active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 4 to 8, and temperatures of from 30 to 80° C. Spectral sensitization and sensitizing dyes, which can take any conventional form, are illustrated by section V. Spectral sensitization and desensitization. The dye may be added to an emulsion of the silver halide grains and a hydrophilic colloid at any time prior to (e.g., during or after chemical sensitization) or simultaneous with the coating of the emulsion on a photographic element. The dyes may, for example, be added as a solution in water or an alcohol or as a dispersion of solid particles. The emulsion layers also typically include one or more antifoggants or stabilizers, which can take any conventional form, as illustrated by section VII. Antifoggants and stabilizers.

The silver halide grains to be used in the invention may be prepared according to methods known in the art, such as those described in *Research Disclosure I*, cited above, and James, *The Theory of the Photographic Process*. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

In the course of grain precipitation one or more dopants (grain occlusions other than silver and halide) can be introduced to modify grain properties. For example, any of the various conventional dopants disclosed in *Research Disclosure I*, Section I. Emulsion grains and their preparation, sub-section G. Grain modifying conditions and adjustments, paragraphs (3), (4) and (5), can be present in the emulsions of the invention. In addition it is specifically contemplated to dope the grains with transition metal hexacoordination complexes containing one or more organic ligands, as taught by Olm et al U.S. Pat. No. 5,360,712, the disclosure of which is here incorporated by reference.

It is specifically contemplated to incorporate in the face centered cubic crystal lattice of the grains a dopant capable of increasing imaging speed by forming a shallow electron trap (hereinafter also referred to as a SET) as discussed in *Research Disclosure* Item 36736 published November 1994, here incorporated by reference.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), deionized gelatin, gelatin derivatives (e.g., acetylated gelatin, phthalated gelatin, and the like), and others as described in *Research Disclosure, I*. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers. The vehicle can be present in the emulsion in any amount useful in photographic emulsions. The emulsion can also include any of the addenda known to be useful in photographic emulsions.

While any useful quantity of light sensitive silver, as silver halide, can be employed in the elements useful in this invention, it is preferred that the total quantity be less than 10 g/m$^2$ of silver. Silver quantities of less than 7 g/m$^2$ are preferred, and silver quantities of less than 5 g/m$^2$ are even more preferred. The lower quantities of silver improve the optics of the elements, thus enabling the production of sharper pictures using the elements. These lower quantities of silver are additionally important in that they enable rapid development and desilvering of the elements. Conversely, a silver coating coverage of at least 1.5 g of coated silver per m$^2$ of support surface area in the element is necessary to realize an exposure latitude of at least 2.7 log E while maintaining an adequately low graininess position for pictures intended to be enlarged.

BU contains at least one yellow dye image-forming coupler, GU contains at least one magenta dye image-forming coupler, and RU contains at least one cyan dye image-forming coupler. Any convenient combination of conventional dye image-forming couplers can be employed. Conventional dye image-forming couplers are illustrated by *Research Disclosure I*, cited above, X. Dye image formers and modifiers, B. Image-dye-forming couplers. The photographic elements may further contain other image-modifying compounds such as "Development Inhibitor-Releasing" compounds (DIR's). Useful additional DIR's for elements of the present invention, are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824, DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

DIR compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference.

It is common practice to coat one, two or three separate emulsion layers within a single dye image-forming layer unit. When two or more emulsion layers are coated in a single layer unit, they are typically chosen to differ in sensitivity. When a more sensitive emulsion is coated over a less sensitive emulsion, a higher speed is realized than when the two emulsions are blended. When a less sensitive emulsion is coated over a more sensitive emulsion, a higher contrast is realized than when the two emulsions are blended. It is preferred that the most sensitive emulsion be located nearest the source of exposing radiation and the slowest emulsion be located nearest the support.

One or more of the layer units of the color photothermographic embodiment of the invention is preferably subdivided into at least two, and more preferably three or more sub-unit layers. It is preferred that all light sensitive silver halide emulsions in the color recording unit have spectral sensitivity in the same region of the visible spectrum. In this embodiment, while all silver halide emulsions incorporated in the unit have spectral absorptances according to invention, it is expected that there are minor differences in spectral absorptance properties between them. In still more preferred embodiments, the sensitizations of the slower silver halide emulsions are specifically tailored to account for the light shielding effects of the faster silver halide emulsions of the layer unit that reside above them, in order to provide an imagewise uniform spectral response by the photographic recording material as exposure varies with low to high light levels. Thus higher proportions of peak light absorbing spectral sensitizing dyes may be desirable in the slower emulsions of the subdivided layer unit to account for on-peak shielding and broadening of the underlying layer spectral sensitivity.

The interlayers IL1 and IL2 are hydrophilic colloid layers having as their primary function color contamination reduction-i.e., prevention of oxidized developing agent from migrating to an adjacent recording layer unit before reacting with dye-forming coupler. The interlayers are in part effective simply by increasing the diffusion path length that oxidized developing agent must travel. To increase the effectiveness of the interlayers to intercept oxidized developing agent, it is conventional practice to incorporate oxidized developing agent. Antistain agents (oxidized developing agent scavengers) can be selected from among those disclosed by *Research Disclosure I*, X. Dye image formers and modifiers, D. Hue modifiers/stabilization, paragraph (2). When one or more silver halide emulsions in GU and RU are high bromide emulsions and, hence have significant native sensitivity to blue light, it is preferred to incorporate a yellow. filter, such as Carey Lea silver or a yellow processing solution decolorizable dye, in IL1. Suitable yellow filter dyes can be selected from among those illustrated by *Research Disclosure I*, Section VIII. Absorbing and scattering materials, B. Absorbing materials. In elements of the instant invention, magenta colored filter materials are absent from IL2 and RU.

The antihalation layer unit AHU typically contains a processing solution removable or decolorizable light absorbing material, such as one or a combination of pigments and dyes. Suitable materials can be selected from among those disclosed in *Research Disclosure I*, Section VIII. Absorbing materials. A common alternative location for AHU is between the support S and the recording layer unit coated nearest the support.

The surface overcoats SOC are hydrophilic colloid layers that are provided for physical protection of the color negative elements during handling and processing. Each SOC also provides a convenient location for incorporation of addenda that are most effective at or near the surface of the color negative element. In some instances the surface overcoat is divided into a surface layer and an interlayer, the latter functioning as spacer between the addenda in the surface layer and the adjacent recording layer unit. In another common variant form, addenda are distributed between the surface layer and the interlayer, with the latter containing addenda that are compatible with the adjacent recording layer unit. Most typically the SOC contains addenda, such as coating aids, plasticizers and lubricants, antistats and matting agents, such as illustrated by *Research Disclosure I*, Section IX. Coating physical property modifying addenda. The SOC overlying the emulsion layers additionally preferably contains an ultraviolet absorber, such as illustrated by *Research Disclosure I*, Section VI. UV dyes/optical brighteners/luminescent dyes, paragraph (1).

Instead of the layer unit sequence of element SCN-1, alternative layer units sequences can be employed and are particularly attractive for some emulsion choices. Using high chloride emulsions and/or thin (<0.2 $\mu$m mean grain thickness) tabular grain emulsions all possible interchanges of the positions of BU, GU and RU can be undertaken without risk of blue light contamination of the minus blue records, since these emulsions exhibit negligible native sensitivity in the visible spectrum. For the same reason, it is unnecessary to incorporate blue light absorbers in the interlayers.

When the emulsion layers within a dye image-forming layer unit differ in speed, it is conventional practice to limit the incorporation of dye image-forming coupler in the layer of highest speed to less than a stoichometric amount, based on silver. The function of the highest speed emulsion layer is to create the portion of the characteristic curve just above the minimum density —i.e., in an exposure region that is below the threshold sensitivity of the remaining emulsion layer or layers in the layer unit. In this way, adding the increased granularity of the highest sensitivity speed emulsion layer to the dye image record produced is minimized without sacrificing imaging speed.

In the foregoing discussion the blue, green and red recording layer units are described as containing yellow, magenta and cyan image dye-forming couplers, respectively, as is conventional practice in color negative elements used for printing. The invention can be suitably applied to conventional color negative construction as illustrated. Color reversal film construction would take a similar form, with the exception that colored masking couplers would be completely absent; in typical forms, development inhibitor releasing couplers would also be absent. In preferred embodiments, the color negative elements are intended exclusively for scanning to produce three separate electronic color records. Thus the actual hue of the image dye produced is of no importance. What is essential is merely that the dye image produced in each of the layer units be differentiable from that produced by each of the remaining layer units. To provide this capability of differentiation it is contemplated that each of the layer units contain one or more dye image-forming couplers chosen to produce image dye having an absorption half-peak bandwidth lying in a different spectral region. It is immaterial whether the blue, green or red recording layer unit forms a yellow, magenta or cyan dye having an absorption half peak bandwidth in the blue, green or red region of the spectrum, as is conventional in a color negative element intended for use in printing, or an absorption half-peak bandwidth in any other convenient region of the spectrum, ranging from the near ultraviolet (300–400 nm) through the visible and through the near infrared (700–1200 nm), so long as the absorption half-peak bandwidths of the image dye in the layer units extend over substantially non-coextensive wavelength ranges. The term "substantially non-coextensive wavelength ranges" means that each image dye exhibits an absorption half-peak band width that extends over at least a 25 (preferably 50) nm spectral region that is not occupied by an absorption half-peak band width of another image dye. Ideally the image dyes exhibit absorption half-peak band widths that are mutually exclusive.

When a layer unit contains two or more emulsion layers differing in speed, it is possible to lower image granularity in the image to be viewed, recreated from an electronic record, by forming in each emulsion layer of the layer unit a dye image which exhibits an absorption half-peak band width that lies in a different spectral region than the dye images of the other emulsion layers of layer unit. This technique is particularly well suited to elements in which the layer units are divided into sub-units that differ in speed. This allows multiple electronic records to be created for each layer unit, corresponding to the differing dye images formed by the emulsion layers of the same spectral sensitivity. The digital record formed by scanning the dye image formed by an emulsion layer of the highest speed is used to recreate the portion of the dye image to be viewed lying just above minimum density. At higher exposure levels second and, optionally, third electronic records can be formed by scanning spectrally differentiated dye images formed by the remaining emulsion layer or layers. These digital records contain less noise (lower granularity) and can be used in recreating the image to be viewed over exposure ranges above the threshold exposure level of the slower emulsion layers. This technique for lowering granularity is disclosed in greater detail by Sutton U.S. Pat. No. 5,314,794, the disclosure of which is here incorporated by reference.

Each layer unit of the color negative elements of the invention produces a dye image characteristic curve gamma of less than 1.5, which facilitates obtaining an exposure latitude of at least 2.7 log E. A minimum acceptable exposure latitude of a multicolor photographic element is that which allows accurately recording the most extreme whites (e.g., a bride's wedding gown) and the most extreme blacks (e.g., a bride groom's tuxedo) that are likely to arise in photographic use. An exposure latitude of 2.6 log E can just accommodate the typical bride and groom wedding scene. An exposure latitude of at least 3.0 log E is preferred, since this allows for a comfortable margin of error in exposure level selection by a photographer. Even larger exposure latitudes are specifically preferred, since the ability to obtain accurate image reproduction with larger exposure errors is realized. Whereas in color negative elements intended for printing, the visual attractiveness of the printed scene is often lost when gamma is exceptionally low, when color negative elements are scanned to create digital dye image records, contrast can be increased by adjustment of the electronic signal information. When the elements of the invention are scanned using a reflected beam, the beam travels through the layer units twice. This effectively doubles gamma ($\Delta D \div \Delta$ log E) by doubling changes in density ($\Delta D$). Thus, gamma's as low as 1.0 or even 0.6 are contemplated and exposure latitudes of up to about 5.0 log E or higher are feasible. Gammas of about 0.55 are preferred. Gammas of between about 0.4 and 0.5 are especially preferred.

Instead of employing dye-forming couplers, any of the conventional incorporated dye image generating compounds employed in multicolor imaging can be alternatively incorporated in the blue, green and red recording layer units. Dye images can be produced by the selective destruction, formation or physical removal of dyes as a function of exposure. For example, silver dye bleach processes are well known and commercially utilized for forming dye images by the selective destruction of incorporated image dyes. The silver dye bleach process is illustrated by *Research Disclosure I*, Section X. Dye image formers and modifiers, A. Silver dye bleach.

It is also well known that pre-formed image dyes can be incorporated in blue, green and red recording layer units, the dyes being chosen to be initially immobile, but capable of releasing the dye chromophore in amobile moiety as a function of entering into a redox reaction with oxidized developing agent. These compounds are commonly referred to as redox dye releasers (RDR's). By washing out the released mobile dyes, a retained dye image is created that can be scanned. It is also possible to transfer the released mobile dyes to a receiver, where they are immobilized in a mordant layer. The image-bearing receiver can then be scanned. Initially the receiver is an integral part of the color negative element. When scanning is conducted with the receiver remaining an integral part of the element, the receiver typically contains a transparent support, the dye image bearing mordant layer just beneath the support, and a white reflective layer just beneath the mordant layer. Where the receiver is peeled from the color negative element to facilitate scanning of the dye image, the receiver support can be reflective, as is commonly the choice when the dye image is intended to be viewed, or transparent, which allows transmission scanning of the dye image. RDR's as well as dye image transfer systems in which they are incorporated are described in *Research Disclosure*, Vol. 151, November 1976, Item 15162.

It is also recognized that the dye image can be provided by compounds that are initially mobile, but are rendered immobile during imagewise development. Image transfer systems utilizing imaging dyes of this type have long been used in previously disclosed dye image transfer systems. These and other image transfer systems compatible with the practice of the invention are disclosed in *Research Disclosure*, Vol. 176, December 1978, Item 17643, XXIII. Image transfer systems.

A number of modifications of color negative elements have been suggested for accommodating scanning, as illustrated by *Research Disclosure I*, Section XIV. Scan facilitating features. These systems to the extent compatible with the color negative element constructions described above are contemplated for use in the practice of this invention.

It is also contemplated that the imaging element of this invention may be used with non-conventional sensitization schemes. For example, instead of using imaging layers sensitized to the red, green, and blue regions of the spectrum, the light-sensitive material may have one white-sensitive layer to record scene luminance, and two color-sensitive layers to record scene chrominance. Following development, the resulting image can be scanned and digitally reprocessed to reconstruct the full colors of the original scene as described in U.S. Pat. No. 5,962,205. The imaging element may also comprise a pan-sensitized emulsion with accompanying color-separation exposure. In this embodiment, the developers of the invention would give rise to a colored or neutral image which, in conjunction with the separation exposure, would enable full recovery of the original scene color values. In such an element, the image may be formed by either developed silver density, a combination of one or more conventional couplers, or "black" couplers such as resorcinol couplers. The separation exposure may be made either sequentially through appropriate filters, or simultaneously through a system of spatially discreet filter elements (commonly called a "color filter array").

The imaging element of the invention may also be a black and white image-forming material comprised, for example, of a pan-sensitized silver halide emulsion and a developer. In this embodiment, the image may be formed by developed silver density following processing, or by a coupler that generates a dye which can be used to carry the neutral image tone scale.

When conventional yellow, magenta, and cyan image dyes are formed to read out the recorded scene exposures following chemical development of conventional exposed color photographic materials, the response of the red, green, and blue color recording units of the element can be accurately discerned by examining their densities. Densitometry is the measurement of transmitted light by a sample using selected colored filters to separate the imagewise response of the RGB image dye forming units into relatively independent channels. It is common to use Status M filters to gauge the response of color negative film elements intended for optical printing, and Status A filters for color reversal films intended for direct transmission viewing. In integral densitometry, the unwanted side and tail absorptions of the imperfect image dyes leads to a small amount of channel mixing, where part of the total response of, for example, a magenta channel may come from off-peak absorptions of either the yellow or cyan image dyes records, or both, in neutral characteristic curves. Such artifacts may be negligible in the measurement of a film's spectral sensitivity. By appropriate mathematical treatment of the integral density response, these unwanted off-peak density contributions can be completely corrected providing analytical densities, where the response of a given color record is independent of the spectral contributions of the other image dyes. Analytical density determination has been summarized in the *SPSE Handbook of Photographic Science and Engineering*, W. Thomas, editor, John Wiley and Sons, New York, 1973, Section 15.3, Color Densitometry, pp. 840–848.

Elements having excellent light sensitivity are best employed in the practice of this invention. Color photothermographic elements should have a sensitivity of at least about ISO 50, preferably have a sensitivity of at least about ISO 100, and more preferably have a sensitivity of at least about ISO 200. Elements having a sensitivity of up to ISO 3200 or even higher are specifically contemplated. The speed, or sensitivity, of a color negative photographic element is inversely related to the exposure required to enable the attainment of a specified density above fog after processing. Photographic speed for a color negative element with a gamma of about 0.65 in each color record has been specifically defined by the American National Standards Institute (ANSI) as ANSI Standard Number pH 2.27–1981 (ISO (ASA Speed)) and relates specifically the average of exposure levels required to produce a density of 0.15 above the minimum density in each of the green light sensitive and least sensitive color recording unit of a color film. This definition conforms to the International Standards Organization (ISO) film speed rating. For the purposes of this application, if the color unit gammas differ from 0.65, the ASA or ISO speed is to be calculated by linearly amplifying or deamplifying the gamma vs. log E (exposure) curve to a value of 0.65 before determining the speed in the otherwise defined manner.

The present invention also contemplates the use of photographic elements of the present invention in what are often referred to as single use cameras (or "film with lens" units). These cameras are sold with film preloaded in them and the entire camera is returned to a processor with the exposed film remaining inside the camera. The one-time-use cameras employed in this invention can be any of those known in the art. These cameras can provide specific features as known in the art such as shutter means, film winding means, film advance means, waterproof housings, single or multiple lenses, lens selection means, variable aperture, focus or focal length lenses, means for monitoring lighting conditions, means for adjusting shutter times or lens characteristics based on lighting conditions or user provided instructions, and means for camera recording use conditions directly on the film. These features include, but are not limited to: providing simplified mechanisms for manually or automatically advancing film and resetting shutters as described at Skarman, U.S. Pat. No. 4,226,517; providing apparatus for automatic exposure control as described at Matterson et al, U.S. Pat. No. 4,345,835; moisture-proofing as described at Fujimura et al, U.S. Pat. No. 4,766,451; providing internal and external film casings as described at Ohmura et al, U.S. Pat. No. 4,751,536; providing means for recording use conditions on the film as described at Taniguchi et al, U.S. Pat. No. 4,780,735; providing lens fitted cameras as described at Arai, U.S. Pat. No. 4,804,987; providing film supports with superior anti-curl properties as described at Sasaki et al, U.S. Pat. No. 4,827,298; providing a viewfinder as described at Ohmura et al, U.S. Pat. No. 4,812,863; providing a lens of defined focal length and lens speed as described at Ushiro et al, U.S. Pat. No. 4,812,866; providing multiple film containers as described at Nakayama et al, U.S. Pat. No. 4,831,398 and at Ohmura et al, U.S. Pat. No. 4,833,495, providing films with improved anti-friction characteristics as described at Shiba, U.S. Pat. No. 4,866,469; providing winding mechanisms, rotating spools, or resilient sleeves as described at Mochida, U.S. Pat. No. 4,884,087; providing a film patrone or cartridge removable in an axial direction as described by Takei et al at U.S. Pat. Nos. 4,890,130 and 5,063,400; providing an electronic flash means as described at Ohmura et al, U.S. Pat. No. 4,896,178; providing an externally operable member for effecting exposure as described at Mochida et al, U.S. Pat. No. 4,954,857; providing film support with modified sprocket holes and means for advancing said film as described at Murakami, U.S. Pat. No. 5,049,908, providing internal mirrors as described at Hara, U.S. Pat. No. 5,084,719; and providing silver halide emulsions suitable for use on tightly wound spools as described at Yagi et al, European Patent Application 0,466,417 A.

While the film may be mounted in the one-time-use camera in any manner known in the art, it is especially preferred to mount the film in the one-time-use camera such that it is taken up on exposure by a thrust cartridge. Thrust cartridges are disclosed by Kataoka et al U.S. Pat. No. 5,226,613; by Zander U.S. Pat. No. 5,200,777; by Dowling et al U.S. Pat. No. 5,031,852; and by Robertson et al U.S. Pat. No. 4,834,306. Narrow bodied one-time-use cameras suitable for employing thrust cartridges in this way are described by Tobioka et al U.S. Pat. No. 5,692,221.

Cameras may contain a built-in processing capability, for example a heating element. Designs for such cameras including their use in an image capture and display system are disclosed in U.S. patent application Ser. No. 09/388,573 filed Sep. 1, 1999, incorporated herein by reference. The use of a one-time use camera as disclosed in said application is particularly preferred in the practice of this invention.

Photographic elements of the present invention are preferably imagewise exposed using any of the known techniques, including those described in *Research Disclosure I*, Section XVI. This typically involves exposure to light in the visible region of the spectrum, and typically such exposure is of a live image through a lens, although exposure can also be exposure to a stored image (such as a computer stored image) by means of light emitting devices (such as light emitting diodes, CRT and the like). The photothermographic elements are also exposed by means of various forms of energy, including ultraviolet and infrared regions of the electromagnetic spectrum as well as electron beam and beta radiation, gamma ray, x-ray, alpha particle, neutron radiation and other forms of corpuscular wave-like radiant energy in either non-coherent (random phase) or coherent (in phase) forms produced by lasers. Exposures are monochromatic, orthochromatic, or panchromatic depending upon the spectral sensitization of the photographic silver halide.

The photothermographic elements of the present invention are preferably of type B as disclosed in *Research Disclosure I*. Type B elements contain in reactive association a photosensitive silver halide, a reducing agent or developer, optionally an activator, a coating vehicle or binder, and a salt or complex of an organic compound with silver ion. In these systems, this organic complex is reduced during development to yield silver metal. The organic silver salt will be referred to as the silver donor. References describing such imaging elements include, for example, U.S. Pat. Nos. 3,457,075; 4,459,350; 4,264,725 and 4,741,992. In the type B photothermographic material it is believed that the latent image silver from the silver halide acts as a catalyst for the described image-forming combination upon processing. In these systems, a preferred concentration of photographic silver halide is within the range of 0.01 to 100 moles of photographic silver halide per mole of silver donor in the photothermographic material.

The Type B photothermographic element comprises an oxidation-reduction image forming combination that contains an organic silver salt oxidizing agent. The organic silver salt is a silver salt which is comparatively stable to light, but aids in the formation of a silver image when heated to 80° C. or higher in the presence of an exposed photocatalyst (i.e., the photosensitive silver halide) and a reducing agent.

The photosensitive silver halide grains and the organic silver salts of the present invention can be coated so that they are in catalytic proximity during development. They can be coated in contiguous layers, but are preferably mixed prior to coating. Conventional mixing techniques are illustrated by *Research Disclosure*, Item 17029, cited above, as well as U.S. Pat. No. 3,700,458 and published Japanese patent applications Nos. 32928/75, 13224/74, 17216/75 and 42729/76.

Examples of blocked developers that can be used in photographic elements of the present invention include, but are not limited to, the blocked developing agents described in U.S. Pat. No. 3,342,599, to Reeves; *Research Disclosure* (129 (1975) pp. 27–30) published by Kenneth Mason Publications, Ltd., Dudley Annex, 12a North Street, Emsworth, Hampshire P010 7DQ, ENGLAND; U.S. Pat. No. 4,157,915, to Hamaoka et al.; U.S. Pat. No. 4,060,418, to Waxman and Mourning; and in U.S. Pat. No. 5,019,492. Particularly useful are those blocked developers described in U.S. application Ser. No. 09/476,234, filed Dec. 30, 1999, IMAGING ELEMENT CONTAINING A BLOCKED PHOTOGRAPICALLY USEFUL COMPOUND; U.S. application Ser. No. 09/475,691, filed Dec. 30, 1999, IMAGING ELEMENT CONTAINING A BLOCKED PHOTOGRAPHICALLY USEFUL COMPOUND; U.S. application Ser. No. 09/475,703, filed Dec. 30, 1999, IMAGING ELEMENT CONTAINING A BLOCKED PHOTOGRAPHICALLY USEFUL COMPOUND; U.S. application Ser. No. 09/475,690, filed Dec. 30, 1999, IMAGING ELEMENT CONTAINING A BLOCKED PHOTOGRAPHICALLY USEFUL COMPOUND; and U.S. application Ser. No. 09/476,233, filed Dec. 30, 1999, PHOTOGRAPHIC OR photothermographic ELEMENT CONTAINING A BLOCKED PHOTOGRAPHICALLY USEFUL COMPOUND. Further improvements in blocked developers are disclosed in U.S. Ser. No. 09/710,341, U.S. Ser. No. 09/718,014, U.S. Ser. No. 09/711,769, and U.S. Ser. No. 09/710,348. Yet other improvements in blocked developers and their use in photothermographic elements are found in commonly assigned co-pending applications, filed concurrently herewith, U.S. Ser. No. 09/718,027 and U.S. Ser. No. 09/717,742.

In one embodiment of the invention blocked developer for use in the present invention may be represented by the following Structure I:

$$\text{DEV}—(\text{LINK 1})_l—(\text{TIME})_m—(\text{LINK 2})_n—\text{B} \qquad \text{I}$$

wherein,

DEV is a silver-halide color developing agent;

LINK 1 and LINK 2 are linking groups;

TIME is a timing group;

l is 0 or 1;

m is 0, 1, or 2;

n is 0 or 1;

l +n is 1 or 2;

B is a blocking group or B is:

$$—B'—(LINK\ 2)_n—(TIME)_m—(LINK\ 1)_l—DEV$$

wherein B' also blocks a second developing agent DEV. In a preferred embodiment of the invention, LINK 1 or LINK 2 are of Structure II:

II

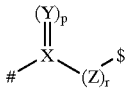

wherein

X represents carbon or sulfur;

Y represents oxygen, sulfur of N—$R_1$, where $R_1$ is substituted or unsubstituted alkyl or substituted or unsubstituted aryl;

p is 1 or 2;

Z represents carbon, oxygen or sulfur, r is 0 or 1; with the proviso that when X is carbon, both p and r are 1, when X is sulfur, Y is oxygen, p is 2 and r is 0;

# denotes the bond to PUG (for LINK 1) or TIME (for LINK 2):

$ denotes the bond to TIME (for LINK 1) or $T_{(t)}$ substituted carbon (for LINK 2).

Illustrative linking groups include, for example,

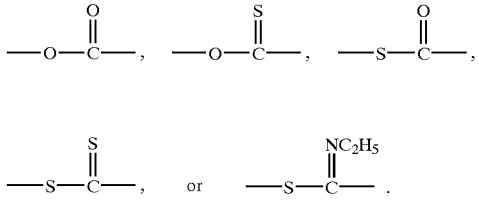

TIME is a timing group. Such groups are well-known in the art such as (1) groups utilizing an aromatic nucleophilic substitution reaction as disclosed in U.S. Pat. No. 5,262,291; (2) groups utilizing the cleavage reaction of a hemiacetal (U.S. Pat. No. 4,146,396, Japanese Applications 60-249148; 60-249149); (3) groups utilizing an electron transfer reaction along a conjugated system (U.S. Pat. Nos. 4,409,323; 4,421,845; Japanese Applications 57-188035; 58-98728; 58-209736; 58-209738); and (4) groups using an intramolecular nucleophilic substitution reaction (U.S. Pat. No. 4,248,962).

Other blocked developers that can be used are, for example, those blocked developers disclosed in U.S. Pat. No. 6,303,282 B1 to Naruse et al., U.S. Pat. No. 4,021,240 to Cerquone et al., U.S. Pat. No. 5,746,269 to Ishikawa, U.S. Pat. No. 6,130,022 to Naruse, and U.S. Pat. No. 6,177,227 to Nakagawa, and substituted derivatives of these blocked developers. Although the present invention is not limited to any type of developing agent or blocked developing agent, the following are merely some examples of some photographically useful blocked developers that may be used in the invention to produce developers during heat development.

D-1

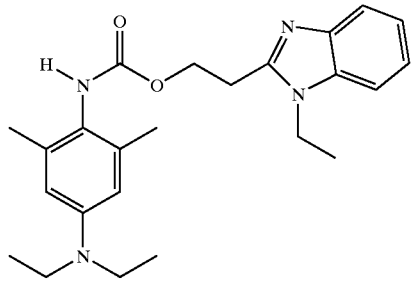

D-2

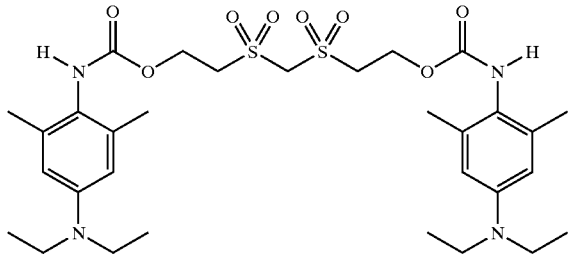

D-3

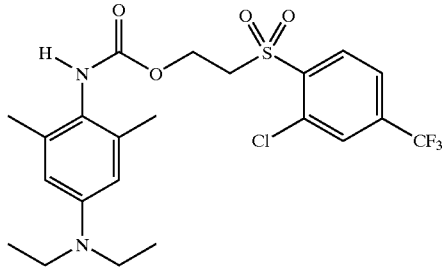

D-4

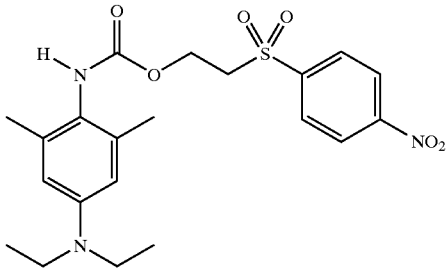

D-5

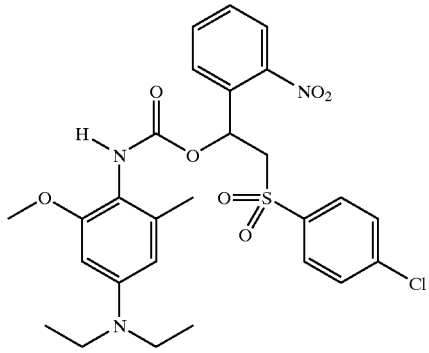

-continued
D-6
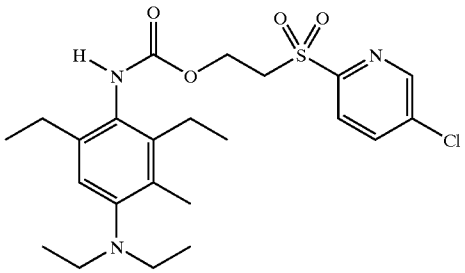
D-7
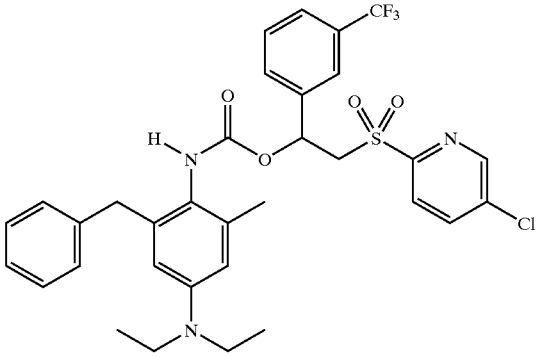
D-8
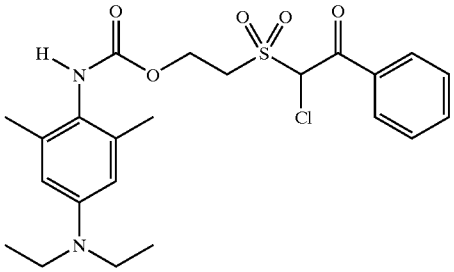
D-9
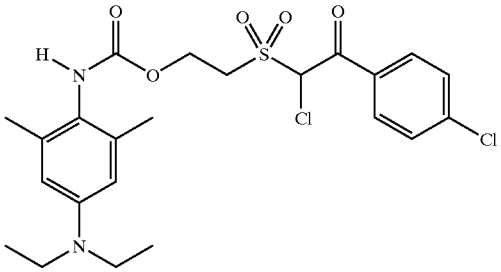
D-10
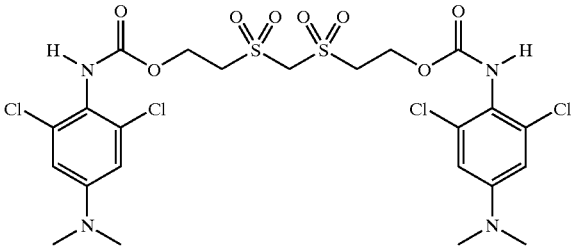
-continued
D-11
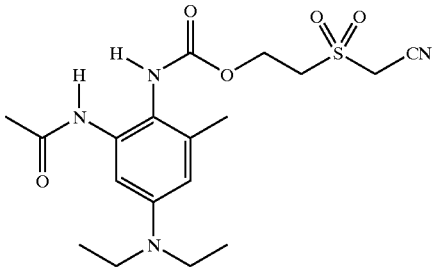
D-12
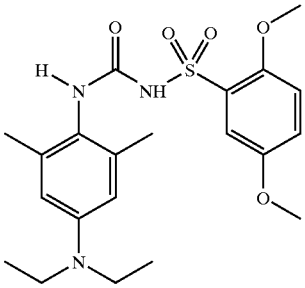
D-13
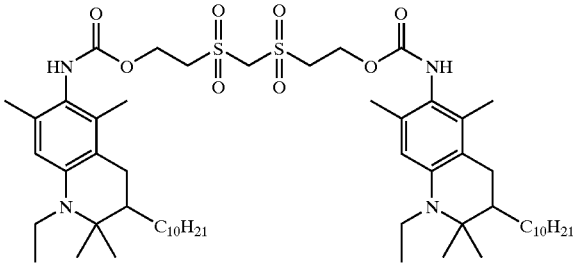
D-14
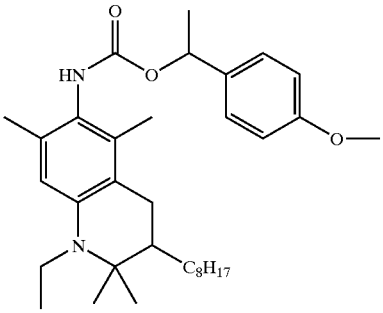
D-15
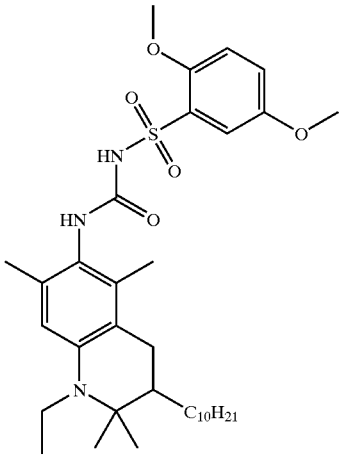

-continued

D-16

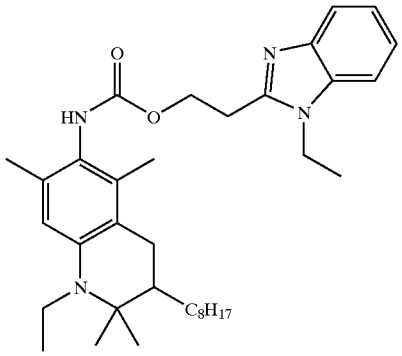

In the preferred embodiment, the blocked developer is preferably incorporated in one or more of the imaging layers of the imaging element. The amount of blocked developer used is preferably 0.01 to 5 g/m$^2$, more preferably 0.1 to 2 g/m$^2$ and most preferably 0.3 to 2 g/m$^2$ in each layer to which it is added. These may be color forming or non-color forming layers of the element. The blocked developer can be contained in a separate element that is contacted to the photographic element during processing.

After image-wise exposure of the imaging element, the blocked developer is activated during processing of the imaging element by the presence of acid or base in the processing solution, by heating the imaging element during processing of the imaging element, and/or by placing the imaging element in contact with a separate element, such as a laminate sheet, during processing. The laminate sheet optionally contains additional processing chemicals such as those disclosed in Sections XIX and XX of *Research Disclosure*, September 1996, Number 389, Item 38957 (hereafter referred to as ("*Research Disclosure* I"). All sections referred to herein are sections of *Research Disclosure I*, unless otherwise indicated. Such chemicals include, for example, sulfites, hydroxyl amine, hydroxamic acids and the like, antifoggants, such as alkali metal halides, nitrogen containing heterocyclic compounds, and the like, sequestering agents such as an organic acids, and other additives such as buffering agents, sulfonated polystyrene, stain reducing agents, biocides, desilvering agents, stabilizers and the like.

A reducing agent in addition to, or instead of, the blocked developer may be included in the photothermographic element. The reducing agent for the organic silver salt may be any material, preferably organic material, that can reduce silver ion to metallic silver. Conventional photographic developers such as 3-pyrazolidinones, hydroquinones, p-aminophenols, p-phenylenediamines and catechol are useful, but hindered phenol reducing agents are preferred. The reducing agent is preferably present in a concentration ranging from 5 to 25 percent of the photothermographic layer.

A wide range of reducing agents has been disclosed in dry silver systems including amidoximes such as phenylamidoxime, 2-thienylamidoxime and p-phenoxyphenylamidoxime, azines (e.g., 4-hydroxy-3,5-dimethoxybenzaldehydeazine); a combination of aliphatic carboxylic acid aryl hydrazides and ascorbic acid, such as 2,2'-bis(hydroxymethyl)propionylbetaphenyl hydrazide in combination with ascorbic acid; an combination of polyhydroxybenzene and hydroxylamine, a reductone and/or a hydrazine, e.g., a combination of hydroquinone and bis (ethoxyethyl)hydroxylamine, piperidinohexose reductone or formyl-4-methylphenylhydrazine, hydroxamic acids such as phenylhydroxamic acid, p-hydroxyphenyl-hydroxamic acid, and o-alaninehydroxamic acid; a combination of azines and sulfonamidophenols, e.g., phenothiazine and 2,6-dichloro-4-benzenesulfonamidophenol; α-cyano-phenylacetic acid derivatives such as ethyl α-cyano-2-methylphenylacetate, ethyl α-cyano-phenylacetate; bis-β-naphthols as illustrated by 2,2'-dihydroxyl-1-binaphthyl, 6,6'-dibromo-2,2'-dihydroxy-1,1'-binaphthyl, and bis(2-hydroxy-1-naphthyl) methane; a combination of bis-o-naphthol and a 1,3-dihydroxybenzene derivative, (e.g., 2,4-dihydroxybenzophenone or 2,4-dihydroxyacetophenone); 5-pyrazolones such as 3-methyl-1-phenyl-5-pyrazolone; reductones as illustrated by dimethylaminohexose reductone, anhydrodihydroaminohexose reductone, and anhydrodihydro-piperidone-hexose reductone; sulfamidophenol reducing agents such as 2,6-dichloro4-benzenesulfon-amido-phenol, and p-benzenesulfonamidophenol; 2-phenylindane-1,3-dione and the like; chromans such as 2,2-dimethyl-7-t-butyl-6-hydroxychroman; 1,4-dihydropyridines such as 2,6-dimethoxy-3,5-dicarbethoxy-1,4-dihydropyridene; bisphenols, e.g., bis(2-hydroxy-3-t-butyl-5-methylphenyl)-methane; 2,2-bis(4-hydroxy-3-methylphenyl)propane; 4,4-ethylidene-bis(2-t-butyl-6-methylphenol); and 2,2-bis(3,5-dimethyl-4-hydroxyphenyl) propane; ascorbic acid derivatives, e.g., 1-ascorbyl-palmitate, ascorbylstearate and unsaturated aldehydes and ketones, such as benzyl and diacetyl; pyrazolidin-3-ones; and certain indane-1,3-diones.

An optimum concentration of organic reducing agent in the photothermographic element varies depending upon such factors as the particular photothermographic element, desired image, processing conditions, the particular organic silver salt and the particular oxidizing agent.

The photothermographic element can comprise a thermal solvent. Examples of thermal solvents, for example, salicylanilide, phthalimide, N-hydroxyphthalimide, N-potassium-phthalimide, succinimide, N-hydroxy-1,8-naphthalimide, phthalazine, 1-(2H)-phthalazinone, 2-acetylphthalazinone, benzanilide, and benzenesulfonamide. Prior-art thermal solvents are disclosed, for example, in U.S. Pat. No. 6,013,420 to Windender. Examples of toning agents and toning agent combinations are described in, for example, *Research Disclosure*, June 1978, Item No. 17029 and U.S. Pat. No. 4,123,282.

Post-processing image stabilizers and latent image keeping stabilizers are useful in the photothermographic element. Any of the stabilizers known in the photothermographic art are useful for the described photothermographic element. Illustrative examples of useful stabilizers include photolytically active stabilizers and stabilizer precursors as described in, for example, U.S. Pat. No. 4,459,350. Other examples of useful stabilizers include azole thioethers and blocked azolinethione stabilizer precursors and carbamoyl stabilizer precursors, such as described in U.S. Pat. No. 3,877,940.

The photothermographic elements preferably contain various colloids and polymers alone or in combination as vehicles and binders and in various layers. Useful materials are hydrophilic or hydrophobic. They are transparent or translucent and include both naturally occurring substances, such as gelatin, gelatin derivatives, cellulose derivatives, polysaccharides, such as dextran, gum arabic and the like, and synthetic polymeric substances, such as water soluble polyvinyl compounds like poly(vinylpyrrolidone) and acrylamide polymers. Other synthetic polymeric compounds that are useful include dispersed vinyl compounds such as in latex form and particularly those that increase dimensional stability of photographic elements. Effective polymers include water insoluble polymers of acrylates, such as alkylacrylates and methacrylates, acrylic acid, sulfoacrylates, and those that have cross-linking sites. Preferred high molecular weight materials and resins include poly(vinyl butyral), cellulose acetate butyrate, poly (methylmethacrylate), poly(vinylpyrrolidone), ethyl cellulose, polystyrene, poly(vinylchloride), chlorinated rubbers, polyisobutylene, butadiene-styrene copolymers, copolymers of vinyl chloride and vinyl acetate, copolymers of vinylidene chloride and vinyl acetate, poly(vinyl alcohol) and polycarbonates. When coatings are made using organic solvents, organic soluble resins may be coated by direct mixture into the coating formulations. When coating from aqueous solution, any useful organic soluble materials may be incorporated as a latex or other fine particle dispersion.

Photothermographic elements as described can contain addenda that are known to aid in formation of a useful image. The photothermographic element can contain development modifiers that function as speed increasing compounds, sensitizing dyes, hardeners, anti-static agents, plasticizers and lubricants, coating aids, brighteners, absorbing and filter dyes, such as described in *Research Disclosure*, December 1978, Item No. 17643 and *Research Disclosure*, June 1978, Item No. 17029.

The layers of the photothermographic element are coated on a support by coating procedures known in the photographic art, including dip coating, air knife coating, curtain coating or extrusion coating using hoppers. If desired, two or more layers are coated simultaneously.

A photothermographic element as described preferably comprises a thermal stabilizer to help stabilize the photothermographic element prior to exposure and processing. Such a thermal stabilizer provides improved stability of the photothermographic element during storage. Preferred thermal stabilizers are 2-bromo-2-arylsulfonylacetamides, such as 2-bromo-2-p-tolysulfonylacetamide; 2-(tribromomethyl sulfonyl)benzothiazole; and 6-substituted-2,4-bis (tribromomethyl)-s-triazines, such as 6-methyl or 6-phenyl-2,4-bis(tribromomethyl)-s-triazine.

Imagewise exposure is preferably for a time and intensity sufficient to produce a developable latent image in the photothermographic element.

After imagewise exposure of the photothermographic element, the resulting latent image can be developed in a variety of ways. The simplest is by overall heating the element to thermal processing temperature. This overall heating merely involves heating the photothermographic element to a temperature within the range of about 90° C. to about 180° C. until a developed image is formed, such as within about 0.5 to about 60 seconds. By increasing or decreasing the thermal processing temperature a shorter or longer time of processing is useful. A preferred thermal processing temperature is within the range of about 100° C. to about 160° C. Heating means known in the photothermographic arts are useful for providing the desired processing temperature for the exposed photothermographic element. The heating means is, for example, a simple hot plate, iron, roller, heated drum, microwave heating means, heated air, vapor or the like.

It is contemplated that the design of the processor for the photothermographic element be linked to the design of the cassette or cartridge used for storage and use of the element. Further, data stored on the film or cartridge may be used to modify processing conditions or scanning of the element. Methods for accomplishing these steps in the imaging system are disclosed in commonly assigned, co-pending U.S. patent applications Ser. Nos. 09/206586, 09/206,612, and 09/206,583 filed Dec. 7, 1998, which are incorporated herein by reference. The use of an apparatus whereby the processor can be used to write information onto the element, information which can be used to adjust processing, scanning, and image display is also envisaged. This system is disclosed in U.S. patent applications Ser. No. 09/206,914 filed Dec. 7, 1998 and 09/333,092 filed Jun. 15, 1999, which are incorporated herein by reference.

Thermal processing is preferably carried out under ambient conditions of pressure and humidity. Conditions outside of normal atmospheric pressure and humidity are useful.

The components of the photothermographic element can be in any location in the element that provides the desired image. If desired, one or more of the components can be in one or more layers of the element. For example, in some cases, it is desirable to include certain percentages of the reducing agent, toner, stabilizer and/or other addenda in the overcoat layer over the photothermographic image recording layer of the element. This, in some cases, reduces migration of certain addenda in the layers of the element.

Once yellow, magenta, and cyan dye image records (or other trio of separate "colors") have been formed in the processed photographic elements of certain color embodiments of the invention, conventional techniques can be employed for retrieving the image information for each color record and manipulating the record for subsequent creation of a color balanced viewable image. For example, it is possible to scan the photographic element successively within the blue, green, and red regions of the spectrum or to incorporate blue, green, and red light within a single scanning beam that is divided and passed through blue, green, and red filters to form separate scanning beams for each color record. A simple technique is to scan the photographic element point-by-point along a series of laterally offset parallel scan paths. The intensity of light passing through the element at a scanning point is noted by a sensor which converts radiation received into an electrical signal. Most generally this electronic signal is further manipulated to form a useful electronic record of the image. For example, the electrical signal can be passed through an analog-to-digital converter and sent to a digital computer together with location information required for pixel (point) location within the image. In another embodiment, this electronic signal is encoded with colorimetric or tonal information to form an electronic record that is suitable to allow reconstruction of the image into viewable forms such as computer monitor displayed images, television images, printed images, and so forth.

It is contemplated that imaging elements of this invention will be scanned prior to the removal of silver halide from the element. The remaining silver halide yields a turbid coating, and it is found that improved scanned image quality for such a system can be obtained by the use of scanners that employ diffuse illumination optics. Any technique known in the art for producing diffuse illumination can be used. Preferred systems include reflective systems, that employ a diffusing cavity whose interior walls are specifically designed to produce a high degree of diffuse reflection, and transmissive systems, where diffusion of a beam of specular light is accomplished by the use of an optical element placed in the beam that serves to scatter light. Such elements can be either glass or plastic that either incorporate a component that produces the desired scattering, or have been given a surface treatment to promote the desired scattering.

One of the challenges encountered in producing images from information extracted by scanning is that the number of pixels of information available for viewing is only a fraction of that available from a comparable classical photographic print. It is, therefore, even more important in scan imaging to maximize the quality of the image information available. Enhancing image sharpness and minimizing the impact of aberrant pixel signals (i.e., noise) are common approaches to enhancing image quality. A conventional technique for minimizing the impact of aberrant pixel signals is to adjust each pixel density reading to a weighted average value by factoring in readings from adjacent pixels, closer adjacent pixels being weighted more heavily.

The elements of the invention can have density calibration patches derived from one or more patch areas on a portion of unexposed photographic recording material that was subjected to reference exposures, as described by Wheeler et al U.S. Pat. No. 5,649,260, Koeng at al U.S. Pat. No. 5,563,717, and by Cosgrove et al U.S. Pat. No. 5,644,647.

Illustrative systems of scan signal manipulation, including techniques for maximizing the quality of image records, are disclosed by Bayer U.S. Pat. No. 4,553,156; Urabe et a) U.S. Pat. No. 4,591,923, Sasaki et al U.S. Pat. No. 4,631,578; Alkofer U.S. Pat. No. 4,654,722, Yamada et al U.S. Pat. No. 4,670,793; Klees U.S. Pat. Nos. 4,694,342 and 4,962,542; Powell U.S. Pat. No. 4,805,031; Mayne et al U.S. Pat. No. 4,829,370; Abdulwahab U.S. Pat. No. 4,839,721; Matsunawa et al U.S. Pat. Nos. 4,841,361 and 4,937,662; Mizukoshi et al U.S. Pat. No. 4,891,713; Petilli U.S. Pat. No. 4,912,569; Sullivan et al U.S. Pat. Nos. 4,920,501 and 5,070,413; Kimoto et al U.S. Pat. No. 4,929,979; Hirosawa et al U.S. Pat. No. 4,972,256; Kaplan U.S. Pat. No. 4,977,521; Sakai U.S. Pat. No. 4,979,027; Ng U.S. Pat. No. 5,003,494; Katayama et al U.S. Pat. No. 5,008,950; Kimura et al U.S. Pat. No. 5,065,255; Osamu et al U.S. Pat. No. 5,051,842; Lee et al U.S. Pat. No. 5,012,333; Bowers et al U.S. Pat. No. 5,107,346; Telle U.S. Pat. No. 5,105,266; MacDonald et al U.S. Pat. No. 5,105,469; and Kwon et al U.S. Pat. No. 5,081,692. Techniques for color balance adjustments during scanning are disclosed by Moore et al U.S. Pat. No. 5,049,984 and Davis U.S. Pat. No. 5,541,645.

The digital color records once acquired are in most instances adjusted to produce a pleasingly color balanced image for viewing and to preserve the color fidelity of the image bearing signals through various transformations or renderings for outputting, either on a video monitor or when printed as a conventional color print. Preferred techniques for transforming image bearing signals after scanning are disclosed by Giorgianni et al U.S. Pat. No. 5,267,030, the disclosures of which are herein incorporated by reference. Further illustrations of the capability of those skilled in the art to manage color digital image information are provided by Giorgianni and Madden *Digital Color Management*, Addison-Wesley, 1998.

EXAMPLE 1

The following silver salts were precipitated for the purpose of demonstrating the advantages of the invention.

Comparative Silver Salt SSC-1

This example illustrates the preparation of silver salt SSC-1. A stirred reaction vessel was charged with 480 g of lime processed gelatin and 5602 g of distilled water. A solution containing 507 g of benzotriazole, 3689 g of distilled water, and 1870 g of 2.5 molar sodium hydroxide was prepared (Solution B). The mixture in the reaction vessel was adjusted to a pAg of 7.25 and a pH of 8.00 by additions of Solution B, nitric acid, and sodium hydroxide as needed. A 5.3 1 solution of 0.70 molar silver nitrate was added to the kettle at 38 cc/minute, and the pAg was maintained at 7.25 by a simultaneous addition of Solution B. This process was continued until the silver nitrate solution was exhausted, at which point the mixture was concentrated by ultra filtration. The resulting silver salt dispersion contained fine particles of AgBZT. The particles were observed under a transmission electron microscope to consist of plates with a median grain diameter of 0.40 microns.

Comparative Silver Salt SSC-2

This example illustrates the preparation of silver salt SSC-2. A stirred reaction vessel was charged with 480 g of lime processed gelatin and 5602 g of distilled water. A solution containing 757 g of 1-phenyl-5-mercaptotetrazole (PMT), 3433 g of distilled water, and 1867 g of 2.5 molar sodium hydroxide was prepared (Solution C). The mixture in the reaction vessel was adjusted to a pAg of 7.25 and a pH of 8.00 by additions of Solution C, nitric acid, and sodium hydroxide as needed. A 5.31 solution of 0.70 molar silver nitrate was added to the kettle at 38 cc/minute, and the pAg was maintained at 7.25 by a simultaneous addition of Solution C. This process was continued until the silver nitrate solution was exhausted, at which point the mixture was concentrated by ultra filtration. The resulting silver salt dispersion contained fine particles of AgPMT. The particles were observed under a transmission electron microscope to consist of spheres with a median grain diameter of 0.12 microns.

Comparative Silver Salt SSC-3

The formula for silver salt SSC-1 was followed except that the vessel contents were washed and concentrated by ultra filtration at the end of the precipitation. In this context, washing has the same definition as for the preparation of conventional silver halide emulsions, where the total vessel volume was held constant by distilled water addition until the collected filtrate volume was equal to or greater than twice the starting vessel volume. Washing was followed immediately by concentration. The resulting silver salt dispersion contained fine particles of AgBZT. The particles were observed under a transmission electron microscope to consist of plates with a median grain diameter of 0.40 microns.

Comparative Silver Salt SSC-4

The formula for silver salt SSC-2 was followed except that the vessel contents were washed and concentrated by ultra filtration at the end of the precipitation. The resulting silver salt dispersion contained fine particles of AgPMT. The particles were observed under a transmission electron microscope to consist of spheres with a median grain diameter of 0.23 microns.

Inventive Silver Salt SSI-1

The formula for silver salt SSC-2 was followed utilizing 0.7 M silver nitrate and Solution C until 60 percent of the total silver was precipitated. Solution B was then substituted for Solution C and the precipitation continued until the silver nitrate solution was exhausted, at which point the mixture was concentrated by ultra filtration. The resulting silver salt contained fine core/shell particles with 60% of the total silver as AgPMT in the core and 40% of the total silver as AgBZT in the shell. The particles were observed under a transmission electron microscope to consist of spheres with attached plates with a median grain diameter of 0.20 microns.

Inventive Silver Salt SSI-2

The formula for silver salt SSC-2 was followed utilizing 0.7 M silver nitrate and Solution C until 85 percent of the total silver was precipitated. Solution B was then substituted for Solution C and the precipitation continued until the silver nitrate solution was exhausted, at which point the mixture was concentrated by ultra filtration. The resulting silver salt contained fine core/shell particles with 85% of the total silver as AgPMT in the core and 15% of the total silver as AgBZT in the shell. The particles were observed under a transmission electron microscope to consist of spheres with a median grain diameter of 0.17 microns.

Inventive Silver Salt SSI-3

The formula for silver salt SSC-2 was followed utilizing 0.7 M silver nitrate and Solution C until 95 percent of the total silver was precipitated. Solution B was then substituted for Solution C and the precipitation continued until the silver nitrate solution was exhausted, at which point the mixture was concentrated by ultra filtration. The resulting silver salt contained fine core/shell particles with 95% of the total silver as AgPMT in the core and 5% of the total silver as AgBZT in the shell. The particles were observed under a transmission electron microscope to consist of spheres with a median grain diameter of 0.14 microns.

Inventive Silver Salt SSI-4

The formula for silver salt SSC-1 was followed utilizing 0.7 M silver nitrate and Solution B until 40 percent of the total silver was precipitated. Solution C was then substituted for Solution B and the precipitation continued until the 90 percent of the total silver was precipitated. Solution B was then substituted for Solution C and the precipitation continued until the silver nitrate solution was exhausted, at which point the mixture was concentrated by ultra filtration. The resulting silver salt contained fine core/shell particles with 40% of the total silver as AgBZT in the core, 50% of the total silver as AgPMT in the inner shell, and 10% of the total silver as AgBZT in the outer shell. The particles were observed under a transmission electron microscope to consist of plates with a median grain diameter of 0.52 microns.

EXAMPLE 2

Several of the above silver salts were analyzed by Energy Dispersive Spectroscopy to determine their structure. The instrument detects X-rays emitted from the sample particles as they are imaged with an Analytical Electron Microscope. The energy of the X-rays is indicative of the atoms present. With a thin polymer window, the detector was sensitive to X-rays emitted by sulfur and silver, but not nitrogen. The samples were examined using 200 Kev electrons and a 6.5 nm spot size on an Analytical Electron Microscope. Through the use of appropriate control standards, the measurement can yield quantitative information. Since the instrument configuration could not give information on nitrogen content, the concentration of benzotriazole had to be calculated by subtraction of sulfur concentration from the total silver concentration and is included as "Ag+other" in the table below. Due to the limited number of anionic ligands added in the precipitation, we can confidently assign the "Ag+other" mole percentage to silver benzotriazole. The inventive sample examined by this method was started from AgPMT core particles that were spherical. As the AgBZT shell phase was grown onto these particles, the spheres grew in size and nucleated epitaxial plates that were joined to the spheres. Both regions were probed by the method and are listed as separately in the table below.

TABLE 2-1

| Sample | Description | Grain shape | Mole % Ag + S | Mole % Ag + other |
|---|---|---|---|---|
| SSC-1 | 100% AgBZT | plates | 8 | 92 |
| SSC-2 | 100% AgPMT | spheres | 98 | 2 |
| SSI-1A | spherical region of particles | mixed | 82 | 18 |
| SSI-1B | plate region of particles | mixed | 50 | 50 |

The data in the table show that with reasonable accuracy, the analysis can detect the presence of sulfur from the PMT anion within the silver salts. The data also show that the two regions of the inventive particles contain a mixture of the two silver salts. The spherical regions contain mostly AgPMT while the plate regions contain an equimolar quantity of the two silver salts. Inventive silver salts SSI-2 and SSI-3 did not contain enough AgBZT to fully nucleate the plate regions and thus remained as spheres. While the structure of silver salt SSI-1 is complex, the data show that the inventive particles are growing by the addition of AgPMT on the surface of the AgBZT substrate rather than the nucleation of a separate population of AgPMT particles. Although not fully indicated in these data, there is evidence in Example 3 that the AgPMT in the core is effectively shelled by the AgBZT. Inventive silver salt SSI-4 contained only plates due to the fact that AgBZT was in the nucleated core.

EXAMPLE 3

The following components were used in the preparation of this photographic example, including a list of all of the chemical structures.

Blocked Developer DEV-1

A slurry was milled in water containing developer BD-1 and Olin 10G as a surfactant. The Olin 10G was added at a level of 10% by weight of the BD-1. To the resulting slurry was added water and dry gelatin in order to bring the final concentrations to 13% BD-1 and 4% gelatin. The gelatin was allowed to swell by mixing the components at 15° C. for 90 minutes. After this swelling process, the gelatin was dissolved by bringing the mixture to 40° C. for 10 minutes, followed by cooling to the chill set the dispersion.

Melt Former MF-1 Dispersion

A dispersion of salicylanilide was prepared by the method of ball milling. To a total 20 g sample was added 3.0 gm salicylanilide solid, 0.20 g polyvinyl pyrrolidone, 0.20 g TRITON X-200 surfactant, 1.0 g gelatin, 15.6 g distilled water, and 20 ml of zirconia beads. The slurry was ball milled for 48 hours. Following milling, the zirconia beads were removed by filtration. The slurry was refrigerated prior to use.

Emulsion E-1

A silver halide tabular emulsion with a composition of 97% silver bromide and 3% silver iodide was prepared by conventional means. The resulting emulsion had an equivalent circular diameter of 1.2 microns and a thickness of 0.11 microns. This emulsion was spectrally sensitized to green light by addition of dyes SM-1 and SM-2, and then chemically sensitized with sulfur and gold for optimum performance.

Coupler Dispersion CDM-1

An oil-based coupler dispersion was prepared by conventional means containing coupler M-1[224EV] with tricresyl phosphate at a weight ratio of 1:0.5.

| Compound | Structure |
|---|---|
| BD-1 | 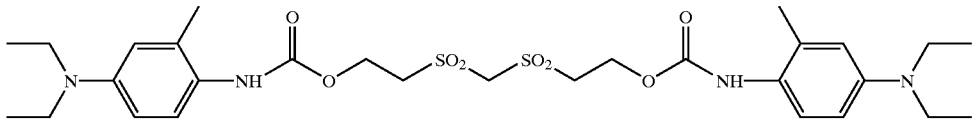 |
| M-1 | 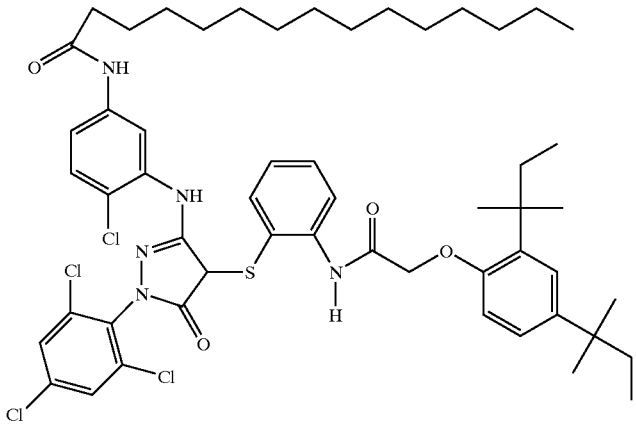 |
| SM-1 | 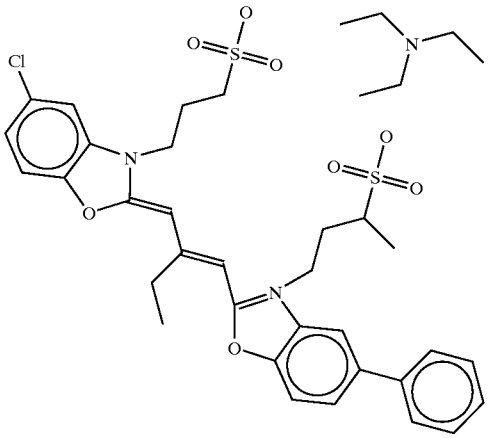 |

-continued

| Compound | Structure |
|---|---|
| SM-2 | 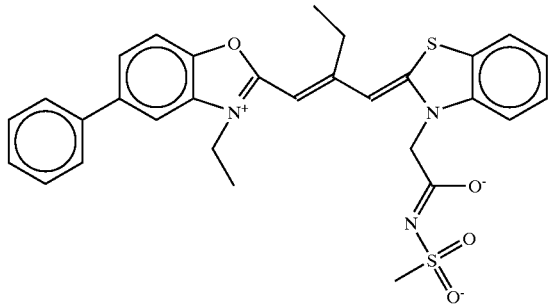 |

All coatings in this example were prepared according to the standard format listed in Table 3–1 below, with variations consisting of changing the sources of organic silver salt. The emulsion E-1 and binder were mixed together in one vessel, while the coupler, developer, silver salts, and melt former were mixed in a separate vessel. Just prior to coating both mixtures were combined and spread onto the support. All coatings were prepared on a 7 mil thick poly (ethylene terephthalate) support.

TABLE 3-1

| Component | Laydown |
|---|---|
| Silver halide (from emulsion E-1) | 0.86 g/m$^2$ |
| Coupler M-1 (from coupler dispersion CDM-1) | 0.54 g/m$^2$ |
| Developer (from DEV-1 dispersion) | 0.86 g/m$^2$ |
| Melt former (from MF-1) | 0.86 g/m$^2$ |
| Lime processed gelatin | 4.31 g/m$^2$ |

The coating variations consisted of changing the level and amount of the silver salts. The control position used both SSC-1 and SSC-2 at a level of 0.32 g/mm$^2$ each. Through experience, a 1:1 ratio of AgBZT and AgPMT were preferred, so that additional AgBZT was coated with the core-shell structures that consisted of less AgBZT than AgPMT. The coated amounts are based on silver, so these coated ratios are on a molar basis. The individual coatings are described in Table 3–2.

TABLE 3-2

| Coating | Silver salt A | Silver salt A Level, g/m$^2$ | Silver salt B | Silver salt B level, g/m$^2$ |
|---|---|---|---|---|
| C-3-1 | SSC-1 | 0.32 | SSC-2 | 0.32 |
| C-3-2 | SSC-1 | 0.32 | SSC-2 | 0.16 |
| I-3-1 | SSI-1 | 0.54 | SSC-1 | 0.11 |
| I-3-2 | SSI-2 | 0.38 | SSC-1 | 0.27 |
| I-3-3 | SSI-3 | 0.34 | SSC-1 | 0.31 |

The resulting coatings were exposed through a step wedge to a 3.04 log lux light source at 5500K filtered with a Wratten 9 filter. The exposure time was 0.01 second. After exposure, the coating was thermally processed by contact with a 160° C. heated platen for 18 seconds. Status M green photographic speeds were measured and are listed in the table as log E×100. Results for the different silver salt variations are given in Table 3–3.

TABLE 3-3

| Coating | Dmin | Dmax | Speed log E × 100 |
|---|---|---|---|
| C-3-1 | 0.18 | 1.60 | 224 |
| C-3-2 | 0.28 | 1.64 | 221 |
| I-3-1 | 0.90 | 1.60 | 246 |
| I-3-2 | 0.29 | 1.87 | 233 |
| I-3-3 | 0.20 | 1.62 | 222 |

The data in the table show that the core-shell materials had fresh speed that was equal to or higher than the separate donor comparison. The higher Dmin for the inventive silver salts with thicker AgBZT shells was an indication that the silver salts had a core/shell structure. That is, the thicker shells made the AgPMT antifoggant less accessible to the surface during development. Coating C-3-2 was an example where the level of AgPMT had been reduced from coating C-3-1, which resulted in the consistent trend of higher fog due to less available antifoggant.

EXAMPLE 4

The coatings in this example were prepared as in Example 3 and are described in Table 4-1.

TABLE 4-1

| Coating | Silver salt A | Silver salt A Level, g/m$^2$ | Silver salt B | Silver salt B level, g/m$^2$ |
|---|---|---|---|---|
| C-4-1 | SSC-1 | 0.32 | SSC-2 | 0.32 |
| I-4-1 | SSI-4 | 0.64 | none | 0.00 |

The resulting coatings were exposed through a step wedge to a 3.04 log lux light source at 5500K filtered with a Wratten 9 filter. The exposure time was 0.01 second. After exposure, the coating was thermally processed by contact with a 160° C. heated platen for 18 seconds. Status M photographic speeds were measured and are listed in the table as log E×100. The minimum and maximum density were also measured. Results for the different silver salt variations are given in Table 4–2.

TABLE 4-2

| Coating | Dmin | Dmax | Speed log E × 100 |
|---|---|---|---|
| C-4-1 | 0.11 | 1.64 | 222 |
| I-4-1 | 0.27 | 1.81 | 239 |

The data in the table clearly show improved density and speed for the inventive core/shell silver salt.

EXAMPLE 5

The following additional components were used in this example.

Coupler Dispersion MC-1

A coupler dispersion was prepared by conventional means containing coupler M-1 at 5.5% and gelatin at 80%. The dispersion contained coupler solvents tricresyl phosphate and CS-1 at weight ratios of 0.8 and 0.2 relative to the coupler M-1, respectively.

M-1

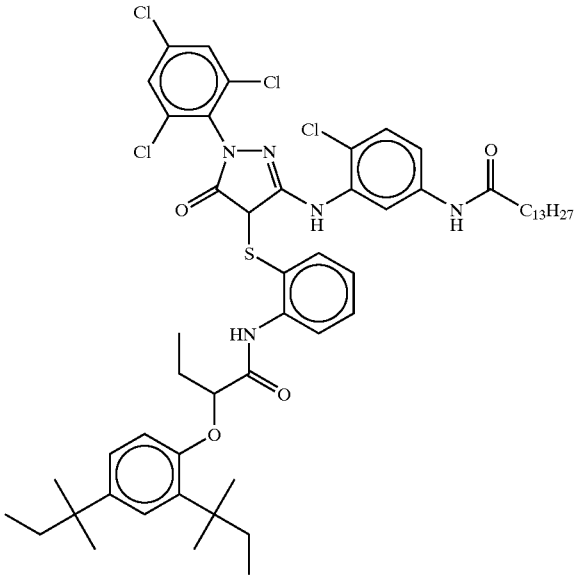

CS-1

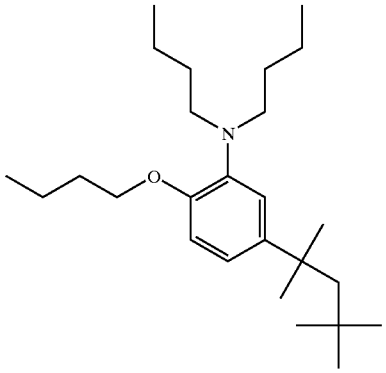

Coupler Dispersion CC-1

An oil based coupler dispersion was prepared by conventional means containing coupler C-1 at 6% and gelatin at 6%. Coupler solvent tricresyl phosphate was included at a weight ratio of 1:1 relative to coupler C-1.

C-1

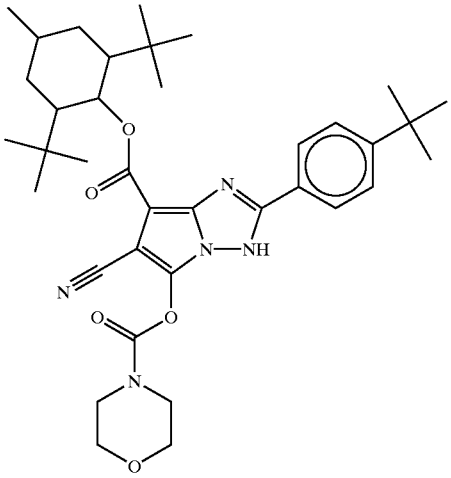

Coupler Dispersion YC-1

An oil based coupler dispersion was prepared by conventional means containing coupler Y-1 at 6% and gelatin at 6%. Coupler solvent CS-2 was included at a weight ratio of 1:1 relative to coupler Y-1.

Y-1:

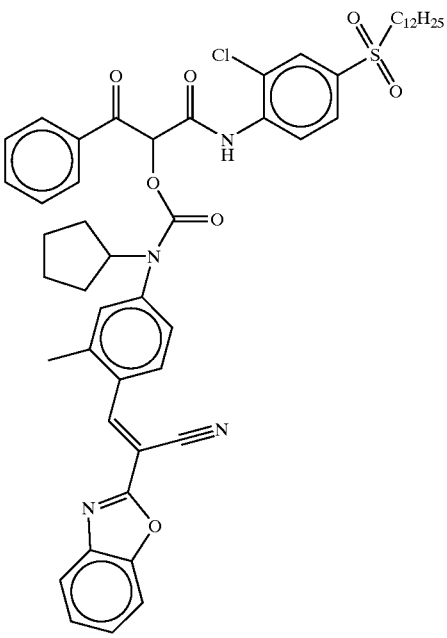

-continued

CS-2:

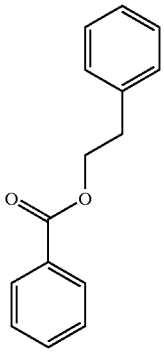

DYE-1

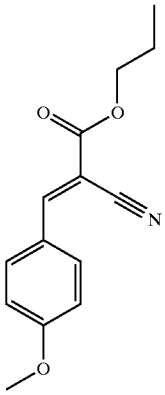

DYE-2

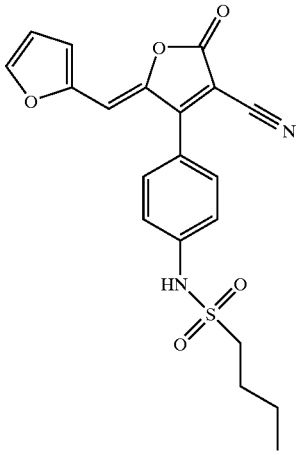

DYE-3

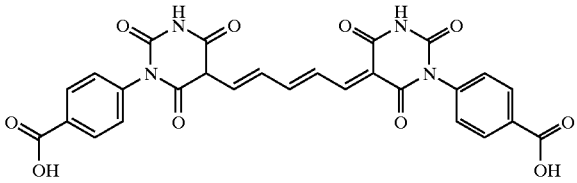

HAR-1

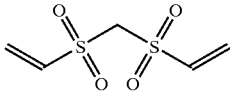

CA-1

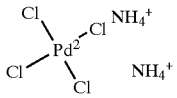

-continued

CA-2

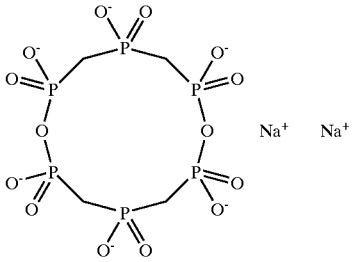

CA-3

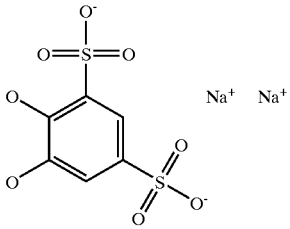

CA-4

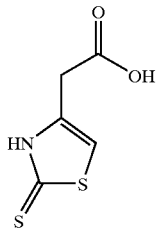

CA-5

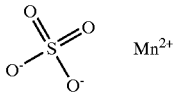

AF-1

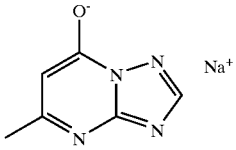

The multilayer structure for coating C-5-1, shown in Table 5-1, was coated on a polyethylene terephthalate support. The coating was accomplished using an extrusion hopper that applied each layer in a sequential process.

TABLE 5-1

| | |
|---|---|
| Overcoat | |
| Gelatin | 1.2960 g/m$^2$ |
| Silicone Polymer DC-200 (Dow Corning) | 0.0389 |
| Matte Beads | 0.1134 |
| DYE-1 (UV) | 0.0972 |
| FC-135 Fluorinated Surfactant | 0.1058 |
| HAR-1 | 0.5108 |
| Fast Yellow | |
| Gelatin | 1.9980 g/m$^2$ |
| SSC-3 | 0.1512 |
| SSC-4 | 0.1512 |
| YC-1 | 0.2160 |
| MF-1 | 0.5184 |
| DEV-1 | 0.5184 |
| Yellow Sens. Emulsion: 3.5 × 0.128 micron | 0.4860 |
| AF-1 | 0.0079 |

TABLE 5-1-continued

| | |
|---|---|
| Slow Yellow | |
| Gelatin | 2.7540 g/m$^2$ |
| SSC-3 | 0.2376 |
| SSC-4 | 0.2376 |
| YC-1 | 0.3780 |
| MF-1 | 0.5832 |
| DEV-1 | 0.5832 |
| Yellow Sens. Emulsion: 1.5 × 0.129 micron | 0.2160 |
| Yellow Sens. Emulsion: 0.6 × 0.139 micron | 0.0756 |
| Yellow Sens. Emulsion: 0.5 × 0.13 micron | 0.1512 |
| Yellow Sens. Emulsion: 0.55 × 0.08 micron | 0.1512 |
| AF-1 | 0.0096 |
| Interlayer 2 | |
| Gelatin | 1.0800 g/m$^2$ |
| CA-1 | 0.0022 |
| DYE-2 | 0.0864 |
| Fast Magenta | |
| Gelatin | 1.7820 g/m$^2$ |
| SSC-3 | 0.1512 |
| SSC-4 | 0.1512 |
| MC-1 | 0.2160 |
| MF-1 | 0.2160 |
| DEV-1 | 0.2160 |
| Magenta Sens. Emulsion: 2.1 × 0.131 micron | 0.4860 |
| AF-1 | 0.0079 |
| Mid Magenta | |
| Gelatin | 1.1340 g/m$^2$ |
| SSC-3 | 0.1188 |
| SSC-4 | 0.1188 |
| MC-1 | 0.1944 |
| MF-1 | 0.1188 |
| DEV-1 | 0.1188 |
| Magenta Sens. Emulsion: 1.37 × 0.119 micron | 0.0648 |
| Magenta Sens. Emulsion: 0.6 × 0.139 micron | 0.1728 |
| AF-1 | 0.0039 |
| Slow Magenta | |
| Gelatin | 1.1340 g/m$^2$ |
| SSC-3 | 0.1188 |
| SSC-4 | 0.1188 |
| MC-1 | 0.1944 |
| MF-1 | 0.1188 |
| DEV-1 | 0.1188 |
| Magenta Sens. Emulsion: 0.5 × 0.13 micron | 0.1080 |
| Magenta Sens. Emulsion: 0.55 × 0.08 micron | 0.1404 |
| AF-1 | 0.0049 |
| Interlayer 1 | |
| Gelatin | 1.0800 g/m$^2$ |
| CA-1 | 0.0022 |
| Fast Cyan | |
| Gelatin | 2.2140 g/m$^2$ |
| SSC-3 | 0.1512 |
| SSC-4 | 0.1512 |
| CC-1 | 0.2592 |
| MF-1 | 0.5184 |
| DEV-1 | 0.5184 |
| Cyan Sens. Emulsion: 2.3 × 0.13 micron | 0.4860 |
| AF-1 | 0.0079 |

TABLE 5-1-continued

| | |
|---|---|
| Mid Cyan | |
| Gelatin | 1.7280 g/m$^2$ |
| SSC-3 | 0.1188 |
| SSC-4 | 0.1188 |
| CC-1 | 0.2322 |
| MF-1 | 0.2916 |
| DEV-1 | 0.2916 |
| Cyan Sens. Emulsion: 1.37 × 0.119 micron | 0.1512 |
| Cyan Sens. Emulsion: 0.6 × 0.139 micron | 0.1512 |
| AF-1 | 0.0039 |
| Slow Cyan | |
| Gelatin | 1.7280 g/m$^2$ |
| SSC-3 | 0.1188 |
| SSC-4 | 0.1188 |
| CC-1 | 0.2322 |
| MF-1 | 0.2916 |
| DEV-1 | 0.2916 |
| Cyan Sens. Emulsion: 0.55 × 0.08 micron | 0.1512 |
| Cyan Sens. Emulsion: 0.5 × 13 micron | 0.1512 |
| AF-1 | 0.0049 |
| AHU | |
| Gelatin | 1.6200 g/m$^2$ |
| DYE-3 | 0.4300 |
| CA-2 | 0.0076 |
| CA-3 | 0.2700 |
| CA-4 | 0.0005 |
| CA-5 | 0.0008 |
| AF-1 | 0.0022 |

Multilayer coating I-5-1 was identical to the above coating except that core/shell silver salt SSI-4 was substituted for both silver salts SSC-3 and SSC-4 in the fast, mid, and slow cyan layers. SSI-4 was coated at 0.2376 g/m$^2$ in each location in the film. The resulting coatings were exposed through a step wedge to a 3.04 log lux light source at 5500 K. The exposure time was 0.01 second. After exposure, the coating was thermally processed by contact with a 158° C. heated platen for 18 seconds, then bleached, fixed, and washed using component baths from the KODAK C-41 process. Status M photographic speeds were measured at 0.15 density above the minimum density and are given in the table as log E×100. The minimum and maximum density were also measured for all three color records. Results for the different silver salt variations are given in Table 5-2.

TABLE 5-2

| Coating | Red Dmin | Green Dmin | Blue Dmin | Red speed | Green speed | Blue speed | Red Dmax | Green Dmax | Blue Dmax |
|---|---|---|---|---|---|---|---|---|---|
| C-5-1 | 0.17 | 0.24 | 0.52 | 376 | 350 | 341 | 2.72 | 2.15 | 2.69 |
| I-5-1 | 0.30 | 0.24 | 0.50 | 389 | 352 | 338 | 2.81 | 2.13 | 2.64 |

The coating containing the core/shell donor demonstrated higher red density and higher red speed than the coating containing the two separate donors. The two layers that were unchanged (green and blue) had equivalent sensitometry.

The invention has been described in detail with particular reference to certain preferred embodiments thereof, but it will be understood that variations and modifications can be effected within the spirit and scope of the invention.

What is claimed is:

1. A color photothermographic element having on a support at least three light-sensitive color imaging layers which have their individual sensitivities in different wavelength regions, each of said imaging layers comprising a light-sensitive silver emulsion, a binder, a dye-providing coupler, and a developer or developer precursor, the dyes formed from the dye-providing couplers in the layers being different in hue, therefore capable of forming at least three dye images of different visible or non-visible colors, wherein at least one imaging layer comprises core/shell particles of non-light sensitive organic silver salts, the particles comprising (i) an outside shell comprising at least one organic silver salt, and (ii) under the outside shell, an underlying particle that comprises a core comprising at least one organic silver salt and, optionally, one or more intermediate shells each comprising at least one organic silver salt, wherein the outside shell is defined as the outermost shell that substantially covers the underlying particle;

said at least one organic silver salt in the outside shell comprising a first organic silver salt and said at least one organic silver salt in the underlying particle comprising a second organic silver salt, wherein said first organic silver salt and said second organic silver salt are different, and the pKsp of said first organic silver salt is at least 0.5 lower than the pKsp of said second organic silver salt.

2. The color photothermographic element of claim 1 wherein greater than 50 mole percent of said at least one organic silver salt in the outside shell comprises one or more first organic silver salts and greater than 50 mole percent of said at least one organic silver salt in the underlying particle comprises one or more second organic silver salts, wherein said first organic silver salts in the outside shell and said second organic silver salts in the underlying particle are different, and wherein the pKsp of said first organic silver salts is at least 0.5 lower than the pKsp of said second organic silver salts.

3. The color photothermographic element of claim 1 wherein the particles comprise (i) an outside shell, comprising at least one organic silver salt, (ii) no intermediate shells, and (iii) a core comprising at least one organic silver salt, said at least one organic silver salt in the outside shell comprises a first organic silver salt, and said at least one organic silver salt in the core particle comprises a second organic silver salt, wherein said first organic silver salt and said second organic silver salt are different, and wherein the pKsp of said first organic silver salt is at least 0.5 lower than the pKsp of said second organic silver salt.

4. The color photothermographic element of claim 3 wherein said core/shell particles comprise essentially only two different organic salts, a first organic silver salt and a second organic silver salt, and wherein the mole percent of the first organic salt in the outside shell is substantially greater that the mole percent of any second organic salt in the outside shell, and the mole percent of the first organic salt in the outside shell is substantially greater than the mole percent of the first organic silver salt in the core.

5. The color photothermographic element of claim 3 wherein said core/shell particles comprise more than two different organic silver salts.

6. The color photothermographic element of claim 1 or 2, wherein said core/shell particles comprise essentially only two different organic silver salts, a first organic silver salt and a second organic silver salt, and wherein the mole percent of the first organic silver salt in the outside shell is substantially greater that the mole percent of any second organic silver salt in the outside shell, and the mole percent of the first organic silver salt in the outside shell is substantially greater than the mole percent of any first organic silver salt in the underlying particle.

7. The color photothermographic element of claim 1 or 2 wherein the total amount of organic silver salt in said outside shell is at least 1 mole percent of the total organic silver in said underlying particle.

8. The color photothermographic element of claim 1 or 2 wherein the molar ratio of total organic silver salt in said outside shell to total organic silver salt in said underlying particle is about 0.1:10 to about 10:1.

9. The color photothermographic element of claim 2 wherein the molar ratio, in the particle, of the one or more first organic silver salts to the one or more second organic silver salts is calculated to be 0.1:10 to about 10:1.

10. The color photothermographic element of claim 1 wherein the molar ratio of said first organic silver salt to said second organic silver salt is from about 0.1:10 to about 10:1.

11. The color photothermographic element of claim 1 or 2 wherein said underlying particle comprises a mixture of two or more different silver salts, or said outside shell comprises a mixture of two or more different silver salts, or both said underlying particle and outside shell comprise a mixtures of two or more different silver salts, as long as at least one organic silver salt in said underlying particle is different from at least one organic silver salt in said outer shell.

12. The color photothermographic element of claim 1 wherein the first organic silver salt, or the one or more first organic silver salts, is selected from the group consisting of the silver salts of benzotriazoles, triazoles, and derivatives thereof.

13. A color photothermographic element having on a support at least three light-sensitive color imaging layers which have their individual sensitivities in different wavelength regions, each of said imaging layers comprising a light-sensitive silver emulsion, a binder, a dye-providing coupler, and a developer or developer precursor, the dyes formed from the dye-providing couplers in the layers being different in hue, therefore capable of forming at least three dye images of different visible or non-visible colors, wherein at least one imaging layer comprises particles of non-light sensitive organic silver salts, the particles comprising one or more first organic silver salts and one or more second organic silver salts, wherein greater than 50 mole percent of the first organic silver salts in the particle overlies greater than 50 mole percent of the second organic silver salts in the particle;

wherein said first organic silver salts and said second organic silver salts are different, and wherein the pKsp of said first organic silver salts is at least 0.5 lower than the pKsp of said second organic silver salts.

14. The color photothermographic element of claim 13 wherein, in an outermost portion of the particle encompassing 50 mole percent portion of the organic silver salt in the particle, greater than 50 mole percent of the one or more first organic silver salts overlies greater than 50 mole percent of the one or more second organic silver salts in the outermost portion.

15. The color photothermographic element of claim 13, wherein said core/shell particles comprise essentially only two different organic salts.

16. The color photothermographic element of claim 13 wherein there is a gradient in the amount of the one or more first organic silver salts and a gradient in the amount of the one or more second organic silver salts, going from the starting point to the end point of the particle growth, or from the nucleus to the surface.

17. The color photothermographic element of claim 16 wherein the particle is a plate.

18. The color photothermographic element of claim 1, 2, or 13 wherein said particles comprise more than two different organic silver salts.

19. The color photothermographic element of claim 1, 2, or 13 wherein the ratio of said first and second organic silver salt, or the one or more first and second organic silver salts, continuously increases as the distance increases from the starting point to the end point of the particle growth.

20. The color photothermographic element of claim 1, 2, or 13, further comprising, in addition to the core-shell particles, non-photosensitive non-core/shell particles comprising an organic silver salt.

21. The color photothermographic element of claim 1, 2, or 13 wherein the second organic silver salt, or one or more second organic silver salts, comprises a mercapto-functional compound and is present at levels in the range of 5 to 3,000 g/mol of silver halide.

22. The color photothermographic element of claim 1, 2, or 13 wherein the second organic silver salt, or the one or more second organic silver salts, comprises a mercapto-functional heteroaromatic compound comprising 1–4 nitrogen heteroatoms.

23. The color photothermographic element of claim 1, 2, or 13 wherein the second organic silver salt, or the one or more second organic silver salts, is selected from the group consisting of the silver salt of 2-mercaptobenzimidazole, the silver salt of 2-mercapto-5-aminothiadiazole, the silver salt of 5-carboxylic-1-methyl-2-phenyl-4-thiopyridine, the silver salt of mercaptotriazine, and the silver salt of 2-mercaptobenzoxazole.

24. The color photothermographic element of claim 23, wherein the second organic silver salt is a thionamide.

25. The color photothermographic element of claim 1, 2, or 13 wherein the second organic silver salt, or the one or more first second silver salts, is selected from the group consisting of the silver salts of 6-chloro-2-mercapto benzothiazole, 2-mercapto-thiazole, naptho(1,2d)thiazole-2(1H)-thione, 4-methyl-4-thiazoline-2-thione, 2-thiazolidinethione, 4,5-dimethyl-4-thiazoline-2-thione, 4-methyl-5-carboxy-4-thiazoline-2-thione, and 3-(2-carboxyethyl)-4-methyl-4-thiazoline-2-thione.

26. The color photothermographic element of claim 25 wherein the second organic silver salt is a mercapto-triazole or mercapto-tetrazole.

27. The color photothermographic element of claim 1, 2, or 13 wherein the second organic silver salt is, or the one or more second organic silver salts comprise, a silver salt of a compound represented by the following structure:

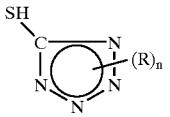

wherein n is 0 or 1, and R is independently selected from the group consisting of substituted or unsubstituted alkyl, aralkyl, or aryl, n is 1, and R is an alkyl having 1 to 16 carbon atoms or a substituted or unsubstituted phenyl group.

28. The color photothermographic element of claim 1, 2, or 13 wherein the first organic silver salt, or the one or more first organic silver salts, has a pKsp of 9–16 and wherein the second organic silver salt, or the one or more second organic silver salts, has a pKsp of 12–19.

29. The color photothermographic element of claim 1, 2, or 13 wherein the first organic silver salt, or the one or more first organic silver salts, comprises a silver salt of an imine group.

30. The color photothermographic element of claim 29 wherein the imine group is part of the ring structure of a heterocyclic structure.

31. The color photothermographic element of claim 30 wherein the heterocyclic ring structure is selected from the group consisting of triazole, benzotriazole, tetrazole, oxazole, thiazole, thiazoline, imidazoline, imidazole, diazole, pyridine, pyrazole, and triazine.

32. The color photothermographic element of claim 1, 2, or 13 wherein the first organic silver salt, or the one or more organic silver salts, is selected from the group consisting of the silver salts of 1H-tetrazole, 5-ethyl-1H-tetrazole, 5-amino-1H-tetrazole, 5-4'methoxyphenyl-1H-tetrazole, and 5-4'carboxyphenyl-1H-tetrazole, benzimidazole, 5-methyl-benzimidazole, imidazole, 2-methyl-benzimidazole, and 2-methyl-5-nitro-benzimidazole, pyrazole, 3,4methyl-pyrazole, 3-phenyl-pyrazole, benzotriazole, 1H-1,2,4-trazole, 3-amino-1,2,4 triazole, 3-amino-5-benzylmercapto-1,2,4-triazole, 5,6-dimethyl benzotriazole, 5-chloro benzotriazole, 4-nitro-6-chloro-benzotriazole, o-benzoic sulfimide, 4-hydroxy-6-methyl-1,3,3A,7-tetraazaindene, 4-hydroxy-6-methyl-1,2,3,3A,7-pentaazaindene, urazole, and 4hydroxy-5-bromo-6-methyl-1,2,3,3A-7-pentaazaindene.

33. The color photothermographic element of claim 1, 2, or 13 wherein the first and the second organic silver salt are both, or the one or more first and second organic silver salts both comprise, a silver salt of a different benzotriazole compound.

34. The color photothermographic element of claim 1, 2, or 13 comprising 5 to 3,000 g/mol of each organic silver salt or each salts/mol silver halide.

35. The color photothermographic element of claim 1, 2, or, 13 wherein the difference in pKsp is at least 1.0.

36. The color photothermographic element of claim 1, 2, or 13 wherein the difference in pKsp is at least 2.0.

37. The photothermographic element of claims 1, 2, or 13 wherein both the first and second organic silver salt have a pKsp greater than 11.

38. A composition comprising:

a) a core/shell non-photosensitive silver salt comprising at least one shell at least partially covering a core, said core comprising a non-photosensitive second organic silver salt and said shell comprising a non-photosensitive first silver salt, wherein said first and second organic silver salts are different, the molar ratio of said first salt to said second salt is from about 0.05:1 to about 20:1, and the pKsp of the first organic silver salt is at least 1.0 lower than the pKsp of the second organic silver salt; and the pKsp of both salts is greater than 11; and b) a hydrophilic or hydrophobic binder.

39. The composition of claim 38 wherein said binder is a hydrophilic binder.

40. The composition of claim 38 further comprising a reducing composition for said non-photosensitive silver ions.

41. The composition of claim 38 further comprising a photocatalyst.

42. The composition of claim 41 wherein the photocatalyst is a silver halide or a mixture of silver halides.

43. A method of making core-shell particles of the non-light-sensitive silver organic salts of claim 1 comprising:

A) preparing a dispersion comprising a non-photosensitive second organic silver salt from silver ions and a second organic coordinating ligand for silver, wherein the second organic silver salt has a relatively high pKsp, and B) forming, by precipitation, at least one shell, comprising a non-photosensitive first organic silver salt, on said second non-photosensitive organic silver salt, in the presence of silver ions, by adding a first silver organic coordinating ligand to said dispersion comprising said non-photosensitive second organic silver salt, wherein the first organic silver salt has a relatively low pKsp, said first and second organic coordinating ligands being different compounds, and the pKsp of both salts being greater than 11.

44. A black-and-white or monochrome photothermographic element having on a support at least one light-sensitive imaging layer comprising a light-sensitive silver emulsion, a binder, and a developer or developer precursor, wherein the imaging layer comprises core/shell particles of non-light-sensitive organic silver salts, the particles comprising (i) an outside shell comprising at least one organic silver salt, and (ii) under the outside shell, an underlying particle that comprises a core comprising at least one organic silver salt and, optionally, one or more intermediate shells each comprising at least one organic silver salt, wherein the outside shell is defined as the outermost shell that substantially covers the underlying particle, said at least one organic silver salt in the outside shell comprising a first organic silver salt and said at least one organic silver salt in the underlying particle comprising a second organic silver salt, wherein said first organic silver salt and said second organic silver salt are different, and the pKsp of said first organic silver salt is at least 0.5 lower than the pKsp of said second organic silver salt, but the pKsp of both salts are greater than 11.

45. The black-and-white or monochrome photothermographic element of claim 44 wherein greater than 50 mole percent of said at least one organic silver salt in the outside shell comprises one or more first organic silver salts and greater than 50 mole percent of said at least one organic silver salt in the underlying particle comprises one or more second organic silver salts, wherein said first organic silver salts and said second organic silver salts are different, wherein the pKsp of said first organic silver salts is at least 0.5 lower than the pKsp of said second organic silver salts, but the pKsp of both salts is greater than 11.

46. A black-and-white or monochrome photothermographic element having on a support at least one light-sensitive imaging layer comprising a light-sensitive silver emulsion, a binder, and a developer or precursor thereof, wherein at least one imaging layer comprises core/shell particles of non-light sensitive organic silver salts, the particles comprising one or more first organic silver salts and one or more second organic silver salts;

wherein greater than 50 mole percent of the one or more first organic silver salts in the particle overlies greater than 50 mole percent of the one or more second organic silver salt in the particle;

wherein said first organic silver salts and said second organic silver salts are different, wherein the pKsp of said first organic silver salts is at least 0.5 lower than the pKsp of said second organic silver salts, but wherein the pKsp of both salts are greater than 11.

47. The black-and-white or monochrome photothermographic element of claims 44, 45 or 46 wherein both the first and second organic silver salt, or both the first and second organic silver salts, do not comprise a carboxylate-containing organic ligand.

* * * * *